US009972929B2

(12) United States Patent
Fernandes et al.

(10) Patent No.: US 9,972,929 B2
(45) Date of Patent: May 15, 2018

(54) MAGNETIC CONTACTING ARRAY

(71) Applicant: I-BLADES, INC., Milpitas, CA (US)

(72) Inventors: Jorge Fernandes, Milpitas, CA (US); Paul Meissner, Milpitas, CA (US)

(73) Assignee: I-BLADES, INC., Milpitas, CA (US)

( * ) Notice: Subject to any disclaimer, the term of this patent is extended or adjusted under 35 U.S.C. 154(b) by 0 days. days.

(21) Appl. No.: 14/876,510

(22) Filed: Oct. 6, 2015

(65) Prior Publication Data

US 2016/0099517 A1 Apr. 7, 2016

Related U.S. Application Data

(60) Provisional application No. 62/060,595, filed on Oct. 7, 2014, provisional application No. 62/060,562, filed on Oct. 6, 2014, provisional application No. 62/110,079, filed on Jan. 30, 2015.

(51) Int. Cl.

| | |
|---|---|
| ***H01H 67/02*** | (2006.01) |
| ***H01R 12/77*** | (2011.01) |
| ***H01R 13/24*** | (2006.01) |
| ***H01R 13/62*** | (2006.01) |
| ***H01R 12/79*** | (2011.01) |
| ***H01F 7/04*** | (2006.01) |
| *H01R 12/72* | (2011.01) |

(52) U.S. Cl.

CPC ..... *H01R 12/77* (2013.01); *H01F 7/04* (2013.01); *H01R 12/79* (2013.01); *H01R 13/2407* (2013.01); *H01R 13/6205* (2013.01); *H01R 12/721* (2013.01)

(58) Field of Classification Search

CPC .... H01H 50/56; H01H 50/546; H01H 50/548; H01H 36/00; H01H 51/287; H01R 13/6205

USPC ..... 335/207, 80, 153–154; 439/38, 305, 439/620.06, 39–40

See application file for complete search history.

(56) References Cited

U.S. PATENT DOCUMENTS 2,573,920 A * 11/1951 McLeod ..... H01H 36/00 174/53
2,905,788 A * 9/1959 Harrison ..... H01H 50/56 200/1 A
2,935,583 A * 5/1960 Howell ..... H01H 36/00 200/19.36
3,868,160 A * 2/1975 Kersman ..... H01R 13/7037 200/51 R
3,869,685 A * 3/1975 Buttel ..... H01H 51/287 335/196
4,317,969 A * 3/1982 Riegler ..... H01R 13/6205 200/51.09
4,697,056 A * 9/1987 Hoffman ..... H01P 1/125 200/305

(Continued)

*Primary Examiner* — Alexander Talpalatski
(74) *Attorney, Agent, or Firm* — Kilpatrick Townsend & Stockton LLP

(57) ABSTRACT

An adaptive magnetic contacting device is described that comprises a plurality of magnets mounted on a flexible printed circuit board. The mounting configuration allows for local bending of the flexible printed circuit board at the point of attachment of each magnet, allowing for direct mating contact between magnetic arrays of devices despite manufacturing variances. The magnets may serve as a mechanical connection, an electrical connection, or both.

8 Claims, 19 Drawing Sheets

(56) References Cited

U.S. PATENT DOCUMENTS

| | | | | |
|---|---|---|---|---|
| 7,492,244 | B2 * | 2/2009 | Hamm | H01H 19/60 335/129 |
| 7,642,886 | B2 * | 1/2010 | Boss | F24C 7/083 200/341 |
| 7,924,124 | B2 * | 4/2011 | Leipold | H01H 36/0073 335/106 |
| 8,497,753 | B2 * | 7/2013 | DiFonzo | H01R 13/6205 335/205 |
| 8,608,502 | B2 * | 12/2013 | Witter | H01R 13/6205 439/335 |
| 8,957,747 | B2 * | 2/2015 | Wilson | H01H 50/005 200/181 |
| 9,253,295 | B2 * | 2/2016 | Samsilova | H04M 1/0249 |
| 2013/0303000 | A1 * | 11/2013 | Witter | H01R 13/6205 439/39 |
| 2016/0099095 | A1 | 4/2016 | Fernandes et al. | |

* cited by examiner

MAGNETIC CONTACTING ARRAY

CROSS-REFERENCES TO RELATED APPLICATIONS

This application claims priority to U.S. Provisional Patent Application No. 62/060,595, filed on Oct. 7, 2014, entitled "Magnetic Contacting Array", U.S. Provisional Patent Application No. 62/110,079, filed Jan. 30, 2015, entitled "Flexible Contact Array System for Mobile Devices", and U.S. Provisional Patent Application No. 62/060,562, filed on Oct. 6, 2014, entitled "Releasable Magnetic Device", the disclosures of which are hereby incorporated by reference in their entirety for all purposes. The disclosure of U.S. patent application Ser. No. 14/017,000, filed on Sep. 3, 2013, published as U.S. Patent Application Publication No. 2014/0065847, is also hereby incorporated by reference in its entirety for all purposes.

The following regular U.S. patent application is being filed concurrently with this one, and the entire disclosure of the other application is incorporated by reference into this application for all purposes: application Ser. No. 14/876,517, filed Oct. 6, 2015, entitled "RELEASABLE MAGNETIC DEVICE".

TECHNICAL FIELD

The present disclosure relates to a magnetic contacting array, and more particularly, to an adaptive magnetic contacting array. The present disclosure further relates to a releasable magnetic device, and a device incorporating the adaptive magnetic contacting array and releasable magnetic device.

BACKGROUND OF THE INVENTION

Magnets have been used as electrical contactors in contact arrays. Such contact arrays have contributed to user convenience by not requiring any cables, nor any of their associated connectors. Despite the progress made in mobile devices and other electronic devices, there is a need in the art for improved devices as well as improved methods of connecting, disconnecting, modularizing, combining and producing them.

SUMMARY OF THE INVENTION

Particularly with respect to mobile devices, it is desirable to contact a first magnetic array with a second magnetic array in an adaptive manner that is tolerant of manufacturing tolerances. It is further desirable to provide a convenient method for releasing a single magnet or a contact array comprising multiple magnets at a coupling interface in an automated context. Thus, the present disclosure relates to an adaptive magnetic contacting array and releasable magnetic device that can be used for these purposes.

An adaptive magnetic contacting device is described that comprises a plurality of magnets mounted on a flexible printed circuit board. The mounting configuration allows for local bending of the flexible printed circuit board at the point of attachment of each magnet, allowing for direct mating contact between magnetic arrays of devices despite manufacturing variances. The magnets may serve as a mechanical connection, an electrical connection, or both. In one embodiment, one or more of the magnets of the adaptive magnetic contacting device are releasable magnetic devices. In another embodiment, the adaptive magnetic contacting device can be used entirely separate from the releasable magnetic device.

An adaptive magnetic contacting device comprises a plurality of magnets mounted on a flexible printed circuit board. The mounting configuration allows local flexing of the flexible printed circuit board at the point of attachment of each magnet. The magnets are arrayed at an inner circle of the flexible printed circuit board, and an attachment to a second printed circuit board is provided at an outer circle. The contacting array provides isolation between a magnet on one side of the flex circuit and a corresponding contact pad on the other side of the flex circuit in one embodiment; in a stacked configuration of multiple devices having contact arrays, this supports isolation of upstream and downstream signals at each connection point of the coupling interface. In another embodiment, isolation is not provided between corresponding sides of the flex circuit. For example, one magnet could be used on both sides of the flex circuit, or two connected magnets could be used on either side of the flex circuit. The contacting device is adaptive because contact surfaces comprising magnet surfaces and corresponding contact pads can be pulled into direct mating contact, either planar or non-planar, owing to the mounting configuration and the flexibility of the flex circuit. Stacked assemblies comprising magnetic contacting arrays at each level of the stack are described, and also an attachment/detachment method comprising magnetic contacting arrays.

According to one embodiment, a magnetic contacting array is provided comprising a first printed circuit board including a first plurality of contact points; a plurality of flexible arms extending from the first printed circuit board including a second plurality of contact points; and a plurality of elements including at least one magnet attached to the second plurality of contact points. At least one contact point of the first plurality of contact points is electrically connected to a contact point of the second plurality of contact points.

According to another embodiment, a magnetic contacting array is provided comprising a first printed circuit board; a first plurality of contact points arrayed on a first surface of the first printed circuit board; a first plurality of elements including at least one first magnet attached to the first plurality of contact points; a second plurality of contact points arrayed opposing the first plurality of contact points on a second surface of the first printed circuit board; a second plurality of elements including at least one second magnet attached to the second plurality of contact points; a third plurality of contact points arrayed on the first surface of the first printed circuit board; and a fourth plurality of contact points arrayed opposing the third plurality of contact points on the second surface of the first printed circuit board. In one embodiment, the first plurality of contact points are electrically isolated from the second plurality of contact points. In the same or another embodiment, at least one contact point of the third plurality of contact points is electrically connected to a contact point of the first plurality of contact points.

A magnetic device is also described for releasably connecting a pair of assemblies; the device may serve as a mechanical connection or as an electrical connection, or both. The device comprises an inner core of high permeability material, a permanent magnet surrounding the inner core, and an outer excitation coil surrounding the permanent magnet. If the permeability of the high permeability material exceeds the permeability of the permanent magnet, for example, by a factor of at least 1,000, a manageable number of amp-turns in the excitation coil is capable of reversing the magnetic effect of the permanent magnet. The magnetic device can be miniaturized and provided in contact arrays suitable for coupling mobile devices, such as those described herein. It can be configured to support high current such as 5 amperes, and high data rates such as 500 Mbps.

According to one embodiment, a releasable magnetic device is provided that comprises a core of high permeability material; a permanent magnet surrounding the core of high permeability material; an excitation coil; a coil driver electrically connected to the excitation coil; a processor configured to activate the excitation coil by driving current through the coil driver; and a memory containing instructions executable by the processor to activate the excitation coil.

According to another embodiment, a contact interface is provided that comprises a first coupling magnet and a second coupling magnet. The first coupling magnet comprises a core of high permeability material; a permanent magnet surrounding the core of high permeability material; an excitation coil; a coil driver electrically connected to the excitation coil; a processor configured to activate the excitation coil by driving current through the coil driver; and a memory containing instructions executable by the processor to activate the excitation coil. The first coupling magnet and the second coupling magnet are coupled at a planar coupling interface when the excitation coil is not activated. The first coupling magnet and the second coupling magnet are uncoupled when the excitation coil is activated.

A method for coupling and uncoupling devices is also described. The method comprises providing a first device comprising a first magnet; providing a second device comprising a core of high permeability material, a second magnet surrounding the core of high permeability material, and an excitation coil; coupling the first device to the second device by magnetic attraction between the first magnet and the second magnet; and activating the excitation coil to uncouple the first device from the second device by a reduction in the magnetic attraction and/or magnetic repulsion between the first magnet and the excitation coil.

A magnetic contacting array incorporating one or more releasable magnetic devices as elements in the contacting array is also provided.

This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claims.

The foregoing, together with other features and embodiments, will become more apparently upon referring to the following specification, claims, and accompanying drawings.

BRIEF DESCRIPTION OF THE DRAWINGS

Illustrative embodiments of the present invention are described in detail below with reference to the following drawing figures.

DETAILED DESCRIPTION OF SPECIFIC EMBODIMENTS

In the following description, for the purposes of explanation, specific details are set forth in order to provide a thorough understanding of embodiments of the invention. However, it will be apparent that various embodiments may be practiced without these specific details. The figures and description are not intended to be restrictive.

The ensuing description provides exemplary embodiments only, and is not intended to limit the scope, applicability, or configuration of the disclosure. Rather, the ensuing description of the exemplary embodiments will provide those skilled in the art with an enabling description for implementing an exemplary embodiment. It should be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other components may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Figure 1:
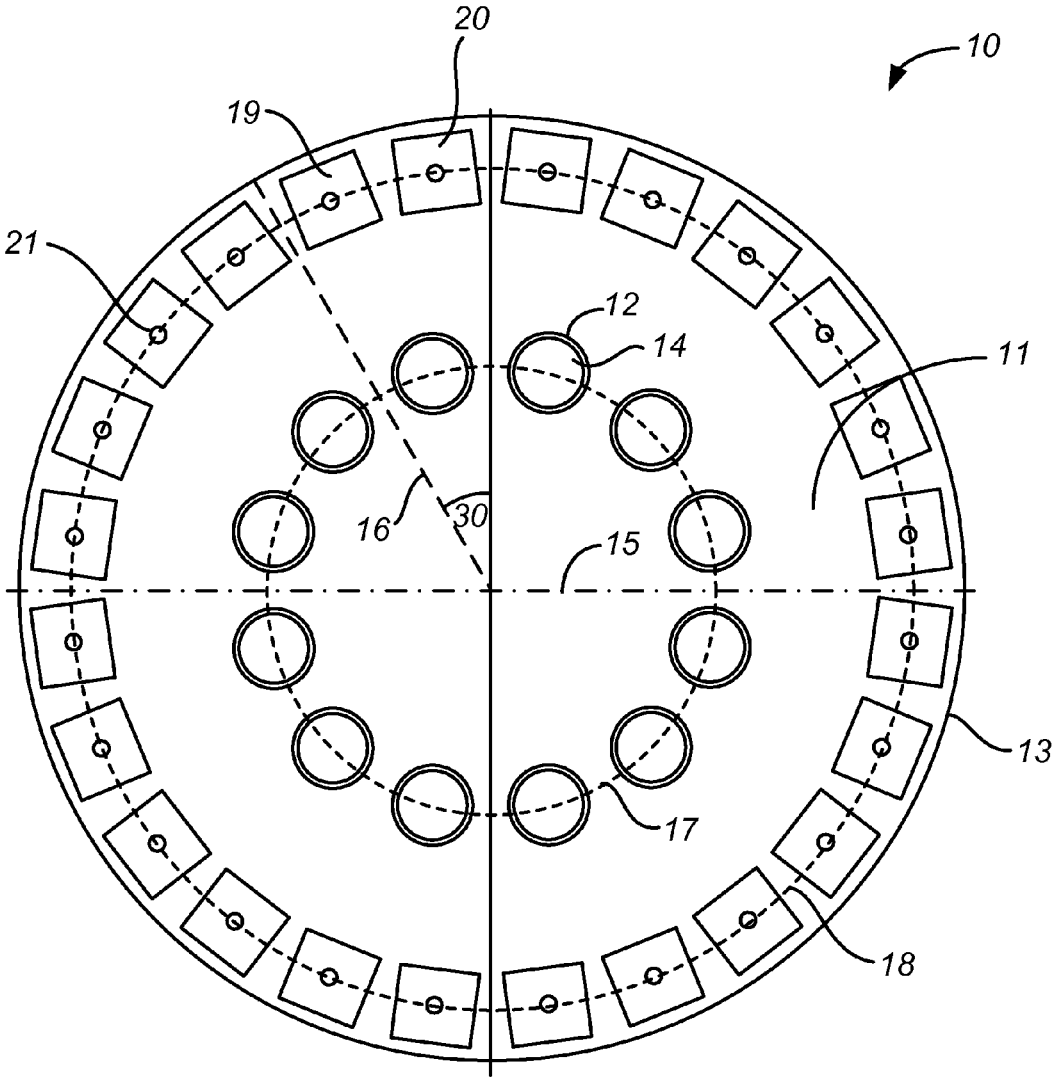
FIG. 1 is a top view of a magnetic contacting array.

FIG. 1 illustrates the top surface 11 of a magnetic contacting array 10, including a first set of contact pads 12 fabricated on a flexible printed circuit board 13, and a matching set of magnets 14 attached to the contact pads 12 using conductive epoxy or the like. Magnets 14 may also be attached to contact pads 12 by other methods, including ultrasonic bonding and low temperature soldering as examples. A second set of contact pads matching contact pads 12 is provided on the reverse side of flexible circuit board 13, to be further described. In one embodiment, magnets 14 are neodymium magnets comprising an alloy of NdFeB with a grade of N42M or better for use in consumer product applications at temperatures up to 100° C. However, it is noted that higher temperatures grades up to 200° C. are available for more demanding environments. A complete contact array of magnets 14, in this case 12 magnets, have a breakaway force of 1-3 pounds in one embodiment when coupled with a similar matching array. The magnetic axis of magnets 14 is preferably perpendicular to the local region of flexible printed circuit board 13 on which each magnet is mounted, and the polarity of each magnet in each adjacent pair of the contact array is preferably reversed. This reversing of polarity of adjacent magnets has the effect of reducing the far field magnetic effect of the magnetic contacting array, which may avoid unwanted disturbance of sensitive magnetic instruments in mobile devices, for example. In addition, such a configuration allows for polarity pairing of magnets to ensure that the magnets only connect with the proper polarity.

Magnetic contacting array 10 is shown with symmetry about center line 15. Segment 16 has a subtended angle of 30 degrees in FIG. 1, and represents 12-fold symmetry about a center axis of the contact array. The 12-fold symmetry is just one example, however, and it is contemplated that the symmetry could be more or less than 12-fold. For each contact pad 12 shown at inner circle 17, two contacts are provided in a third set of contact pads at outer circle 18; these contacts are referred to as a left contact pad 19 and a right contact pad 20 in each segment 16. A fourth set of contact pads is provided on the reverse side of flexible printed circuit board 13, matching the third set of contact pads such as 19, to be further described. A plated through hole 21 is provided in this embodiment at each of the third set of contact pads.

Although shown and described in FIG. 1 as being separate from flexible printed circuit board 13, it is contemplated that any of the contact pads described above and herein can be integral with flexible printed circuit board 13, and contact points on the flexible printed circuit board 13 can instead be utilized. In other words, it is contemplated that magnetic contacting array 10 can be formed of a single piece of flexible printed circuit board 13 with magnets 14 positioned thereon at particular contact points.

Figure 2A:
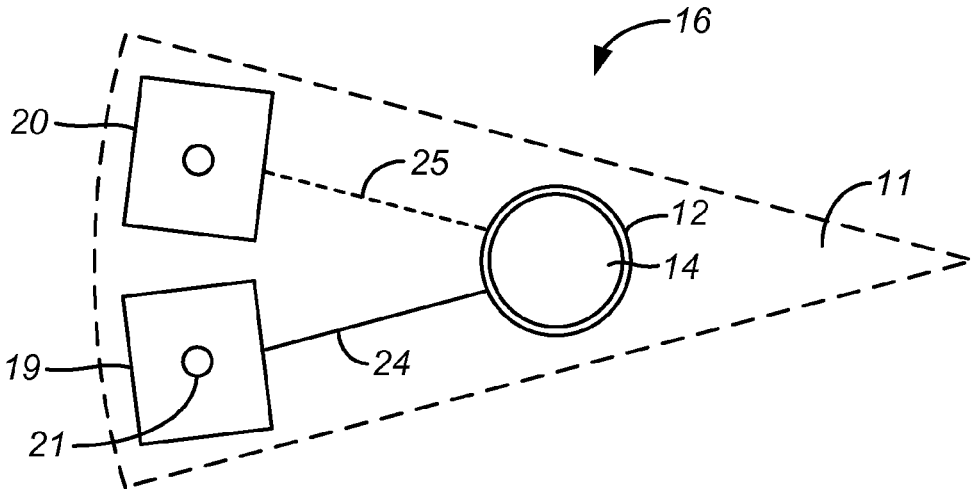
FIG. 2A is an expanded schematic view of a segment of the magnetic contacting array of FIG. 1.

FIG. 2A depicts an enlarged schematic view of segment 16 of FIG. 1. Left contact pad 19, right contact pad 20, and feedthrough 21 are shown, together with first contact pad 12 and magnet 14. On the top surface 11 of flexible printed circuit board 13, trace 24 connects between left contact pad 19 and contact pad 12. On the bottom surface of printed circuit board 13, trace 25 connects between a contact pad of the second set of contact pads, and a corresponding contact pad of the fourth set of contact pads. In other words, the first and second sets of contact pads are electrically isolated from each other in this embodiment, allowing for two different functionalities, if so desired.

Figure 2B:
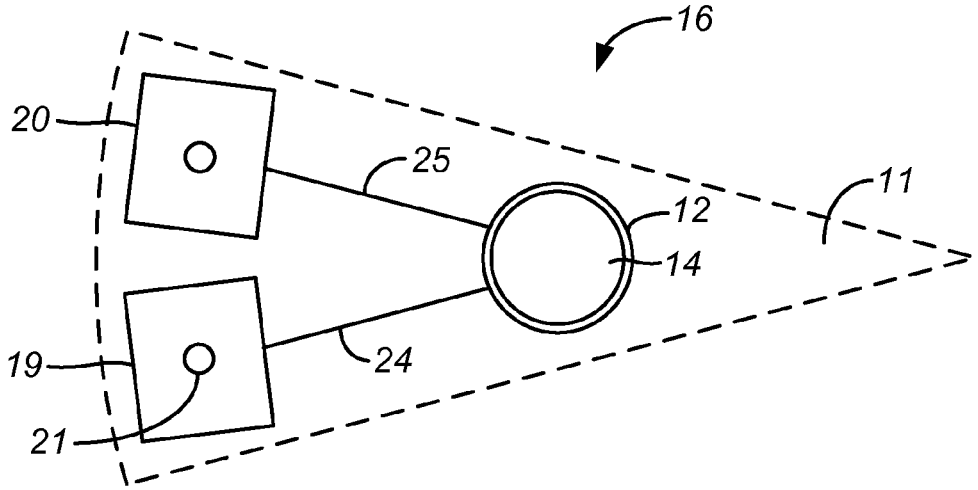
FIG. 2B is another expanded schematic view of a segment of the magnetic contacting array of FIG. 1.

FIG. 2B depicts an enlarged schematic view of segment 16 of FIG. 1 according to another embodiment. On the top surface 11 of flexible printed circuit board 13, trace 24 connects between left contact pad 19 and contact pad 12. Also on the top surface 11 of flexible printed circuit board 13, trace 25 connects between right contact pad 20 and contact pad 12. In this embodiment, traces 24 and 25 provide for high current density.

Figure 3:
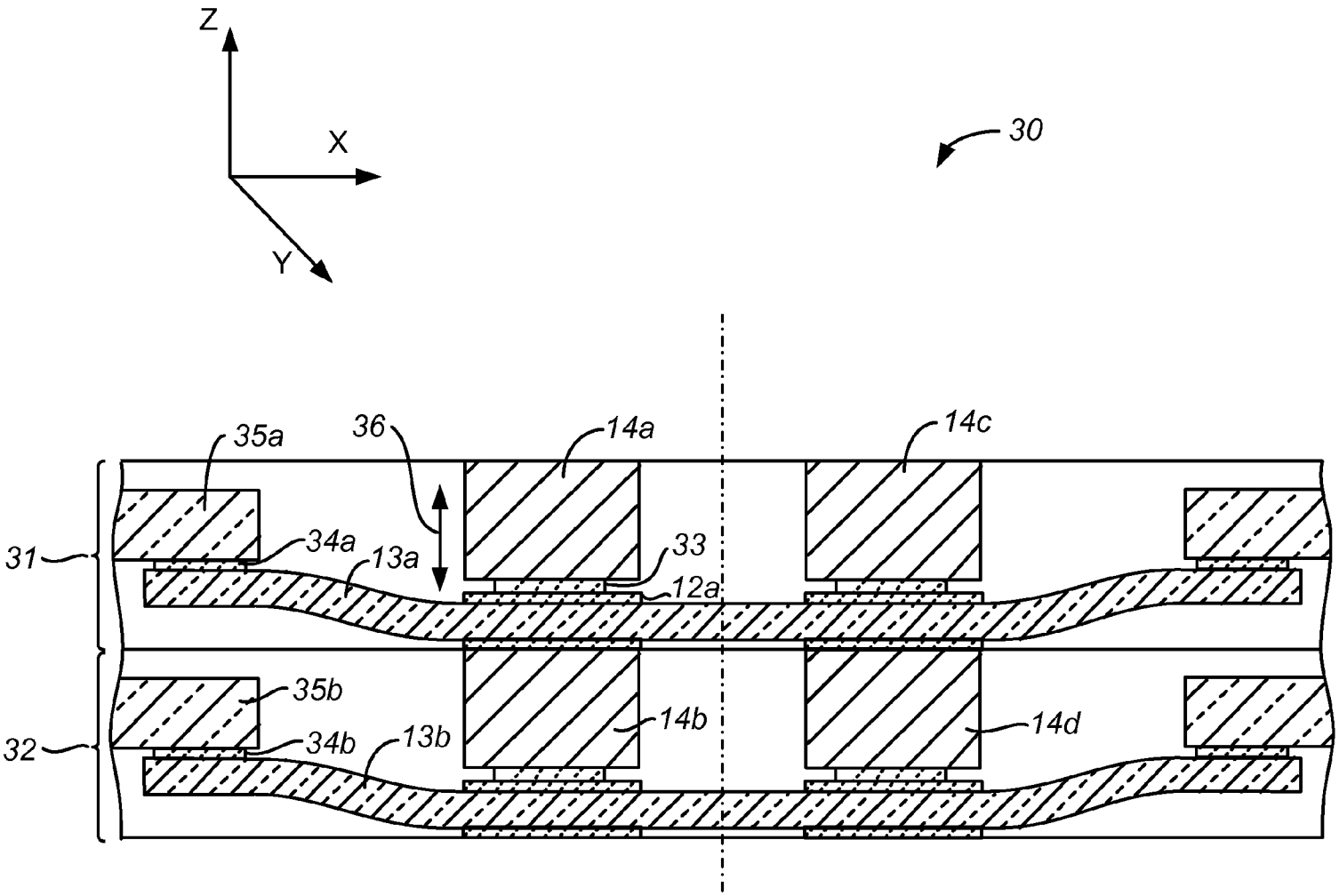
FIG. 3 is an expanded cross-sectional view of a stacked assembly of magnetic contacting arrays.

FIG. 3 illustrates in cross-section a stacked assembly 30 comprising device 31 and device 32, each of device 31 and device 32 comprising a magnetic contacting array such as 10 described in reference to FIG. 1. Magnets 14*a*, 14*b*, 14*c* and 14*d* are shown. Flexible printed circuit boards 13*a* and 13*b* are also shown. Magnet 14*a* connects electrically with a trace (not shown) of flexible printed circuit board 13 via conductive epoxy 33, for example, and contact pad 12*a*. The trace connects further with contact pad 34*a* and from there to a trace (not shown) of second printed circuit board 35 which further connects to a pin of a driver circuit, to be described further herein. Bidirectional arrow 36 indicates that the mounting of magnet 14*a* in device 31 comprises a floating characteristic, wherein the exact location of magnet 14*a* after coupling with magnet 14*b* can vary in the z-direction (by at least 1 mm, in one embodiment), and also can vary slightly in the x- and y-directions, due in part to the flexible characteristic of flexible printed circuit board 13. The potential for substantial adjustments in the z-direction supports an adaptive magnetic contacting array which can adjust to manufacturing tolerances observed in devices 31 and 32, for example. Accordingly, good electrical contact can be provided between corresponding control points 34*a* and 34*b*, supporting currents of at least 2 amperes and data rates of at least 400 Mbps between these points, for example.

Figure 4:
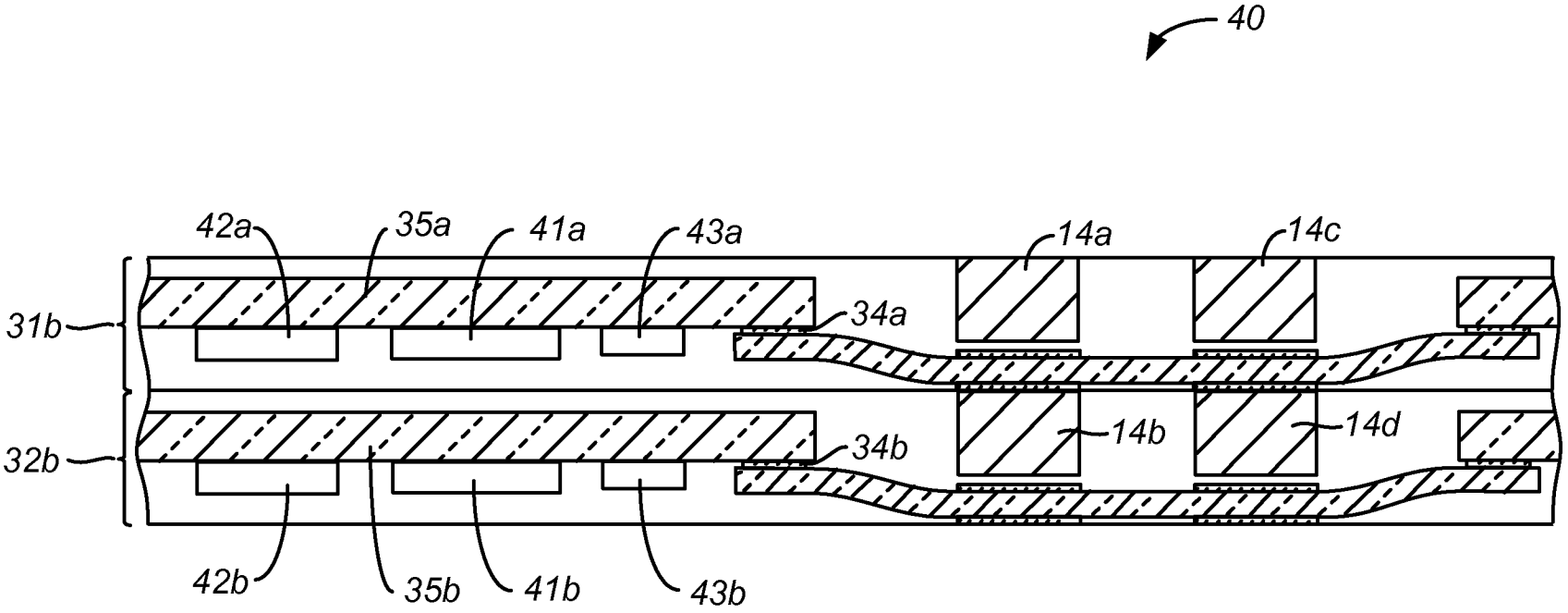
FIG. 4 is another cross-sectional view of a stacked assembly of magnetic contacting arrays.

FIG. 4 is similar to FIG. 3, except that additional components are shown attached to second printed circuit boards 35*a* and 35*b*. In this embodiment, second printed circuits boards 35*a* and 35*b* are rigid circuit boards, but can be flexible in another embodiment. In one example, second printed circuit boards 35*a* and 35*b* have a thickness of around 0.031 inches and support around 6 trace layers, including conductive planes in support of controlled impedance traces for high speed routing of signals. The additional components may include processors 41*a*, 41*b*; memories 42*a*, 42*b*; and drivers 43*a*, 43*b*. Instructions in memory device 42*a* may be executable by processor 41*a* to control driver chip 43*a*, such that control point 34*a* is properly connected to an element of the magnetic contacting array for transmission of an upstream or downstream signal, for example. An upstream signal is routed from the contacting array to the processor, while a downstream signal is routed from the processor to the contacting array, and potentially from there to another device in a stack of devices.

Although shown as described as being separate from and in addition to flexible printed circuit boards 13*a* and 13*b* in FIGS. 3 and 4, it is contemplated that second printed circuit boards 35*a* and 35*b* can be entirely eliminated from one or both of devices 31 and 32 in one embodiment. For example, a single piece of flexible printed circuit board 13*a* can be used in device 31 or 31*b* in place of both flexible printed circuit board 13*a* and second printed circuit board 35*a*. In this embodiment, flexible printed circuit board 13*a* connects directly to processor 41*a*, memory 42*a*, and driver chip 43*a*. A similar configuration can be used in device 32.

Figure 5A:
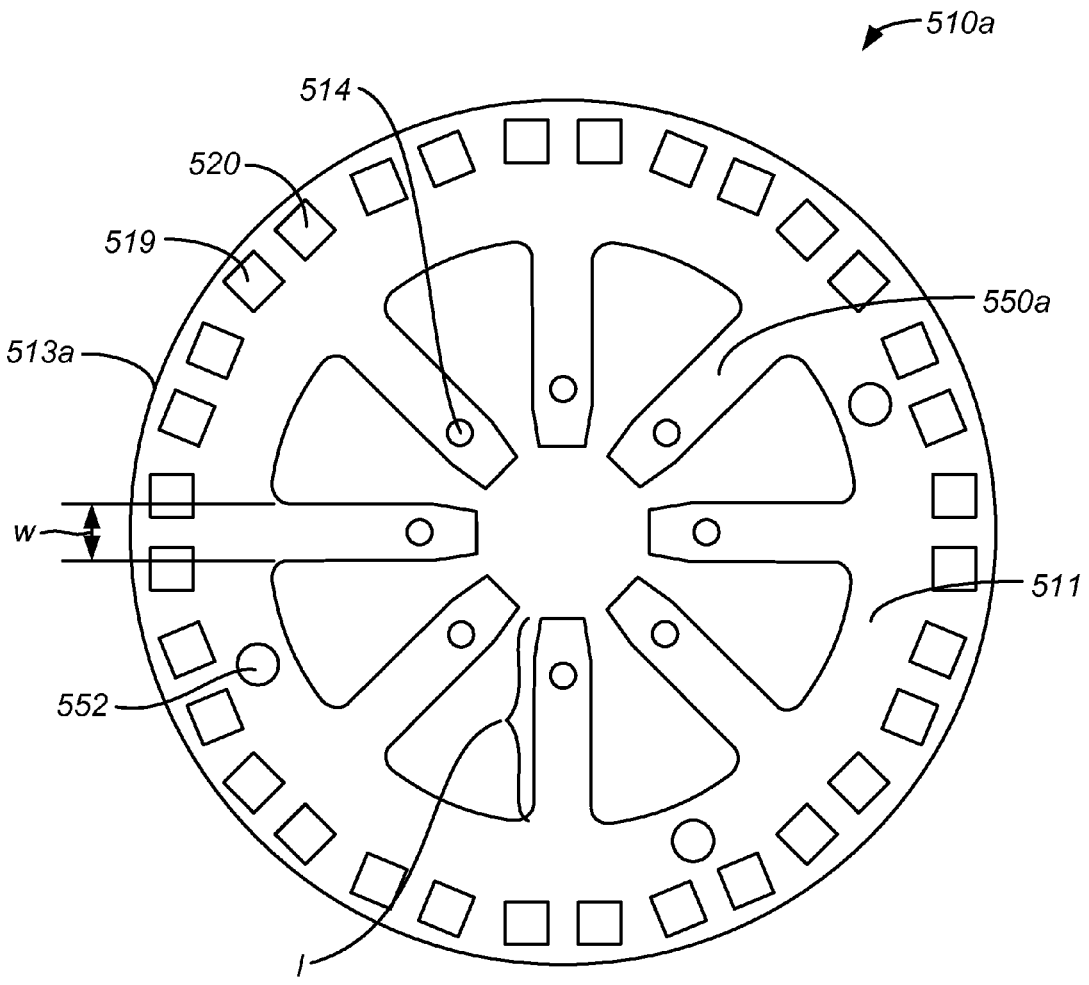
FIG. 5A is a top view of a magnetic contacting array having arms.

FIG. 5A is a top view of a magnetic contacting array 510*a* having arms 550*a*, but can otherwise be similar in design and function to any of the other embodiments of magnetic contacting arrays described herein. Contact pads 519, 520 are positioned at an outer edge of a top surface 511 of flexible printed circuit board 513*a*. Arms 550*a*, having length l and width w, extend inward with respect to contact pads 519 and terminate in magnets 514. Although shown as being similar in length l and width w, it is contemplated that arms 550*a* may be of any length or width entirely independent of one another. Further, although shown and described as extending inward, it is contemplated that arms 550*a* may originate in the middle of magnetic contacting array 510*a* and extend outward instead.

Because arms 550*a* are made of flexible materials, they are able to move to a certain degree, depending on the length l and width w of the arms 550*a*, as well as on the rigidity and thickness of flexible printed circuit board 513, as described further herein. In this embodiment, three reference holes 552 are also provided between arms 550*a* and contact pads 519, 520. However, it is contemplated that reference holes 552 can be provided in any position on contacting array 510*a* and can be of any size or shape, or can be eliminated entirely. In this embodiment, reference holes 552 are provided for manufacturing purposes to properly place magnets 514 on arms 550*a* and/or to align magnetic contacting array 510*a* in a case or housing. In other embodiments, reference holes 552 are not necessary and other tools may be used for alignment during the manufacturing processes, such as a tool with mounted magnets to force magnets 514 into alignment.

Figure 5B:
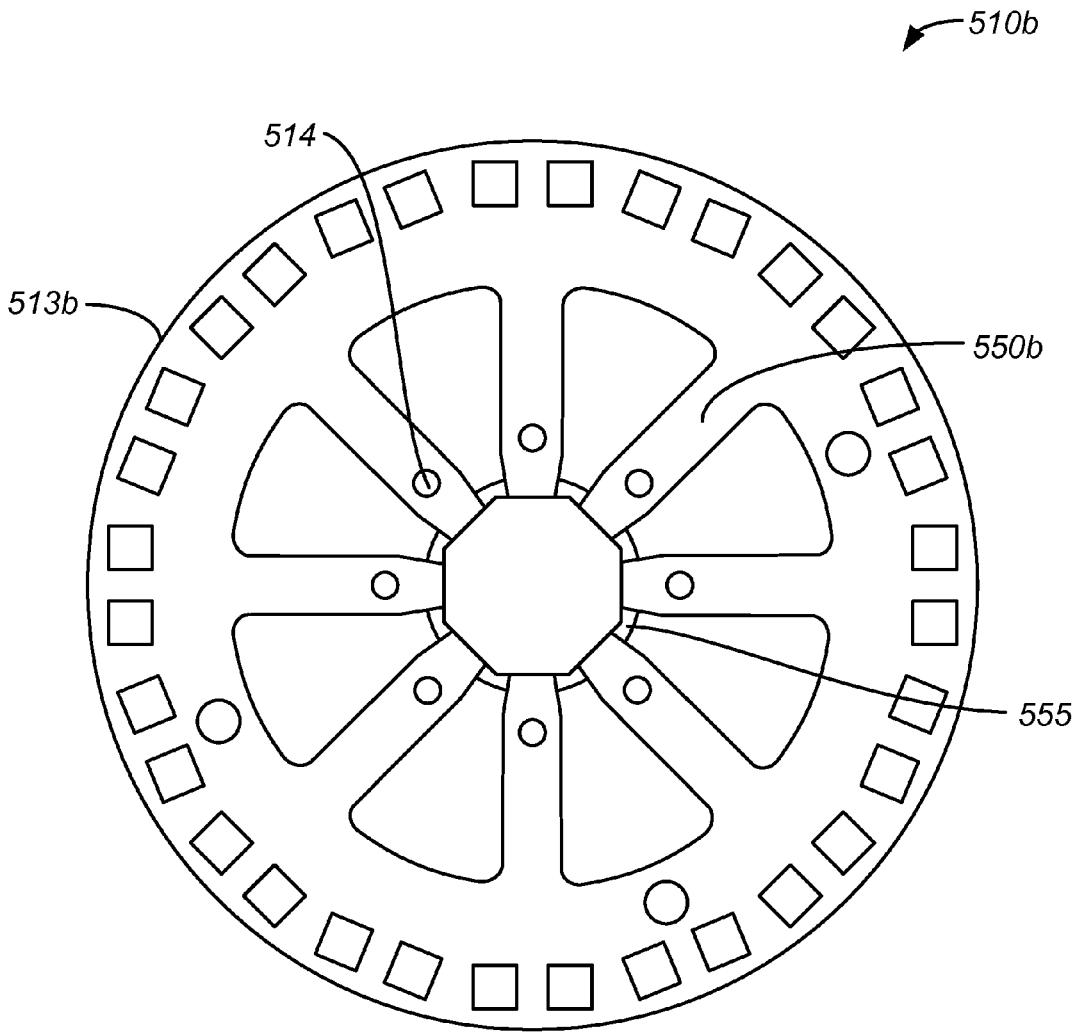
FIG. 5B is another top view of a magnetic contacting array having arms.

FIG. 5B illustrates another embodiment of magnetic contacting array 510*b* having arms 550*b*. In this embodiment, however, arms 550*b* are connected at their innermost points by a ring 555. Ring 555 can either be integral with or separate from flexible printed circuit board 513*b*, and made of the same or a separate material. According to this embodiment, the flexibility of arms 550*b* is restricted, limiting full movement of arms 550*b*. This embodiment avoids jamming of the magnets 514 caused by the potential for unwanted angular movement of arms 550*b* when given their maximum flexibility.

Figure 6:
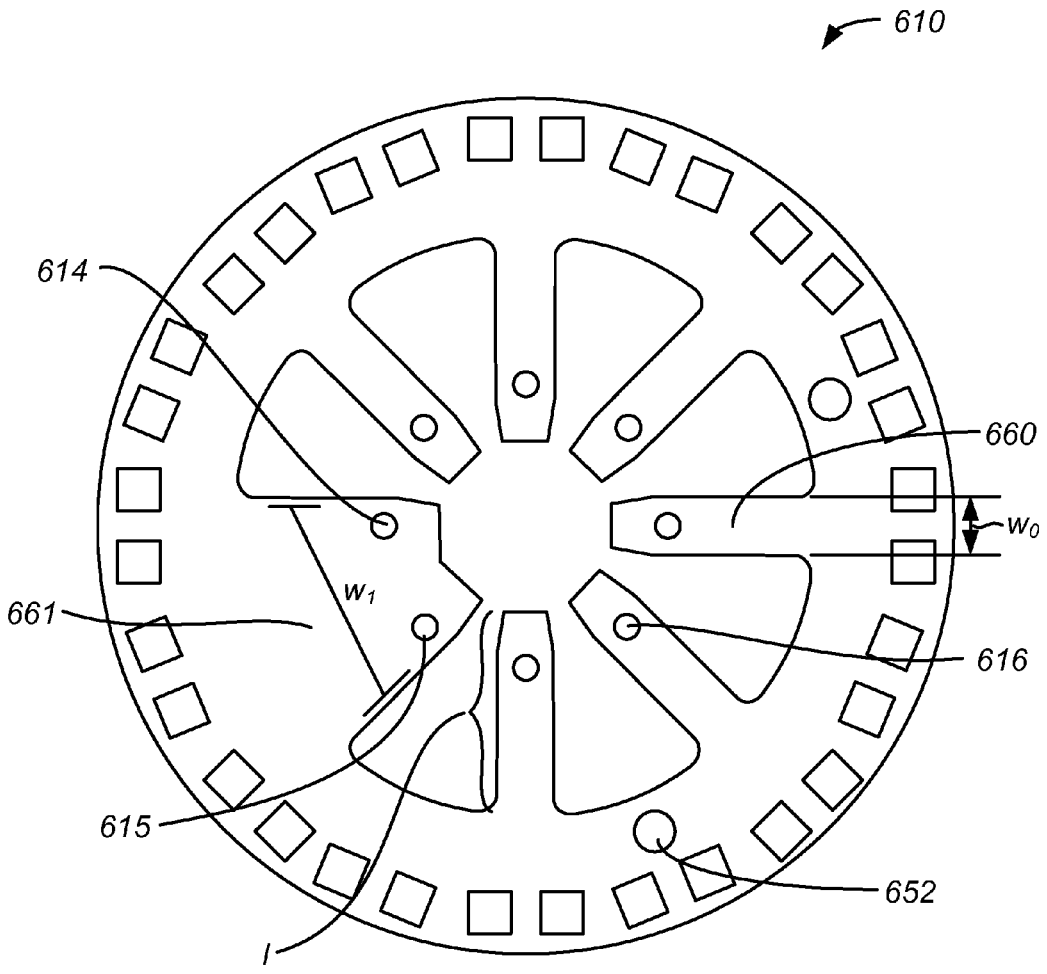
FIG. 6 is another top view of a magnetic contacting array having arms.

FIG. 6 illustrates a further embodiment in which magnetic contacting array 610 has an arm 661 with increased width with respect to arm 660. Although arms 660, 661 are equal in length l, arm 661 has a width $w_1$ which is greater than the width $w_0$ of arm 660. Because arm 661 has an increased width $w_1$, arm 661 is more stable and less flexible than arm 660. Further, arm 661 terminates in two magnets 614, 615, whereas arm 660 terminates in one magnet 616. Thus, arm 661 can accommodate a greater amount of current than arm 660. Otherwise, magnetic contacting array 610 can be similar in design and function to any of the other embodiments of magnetic contacting arrays described herein. In this embodiment, one reference hole 652 is also provided, which can be used as described with respect to reference holes 552 of FIG. 5A. In another embodiment, reference hole 652 can be omitted entirely.

Figure 7A:
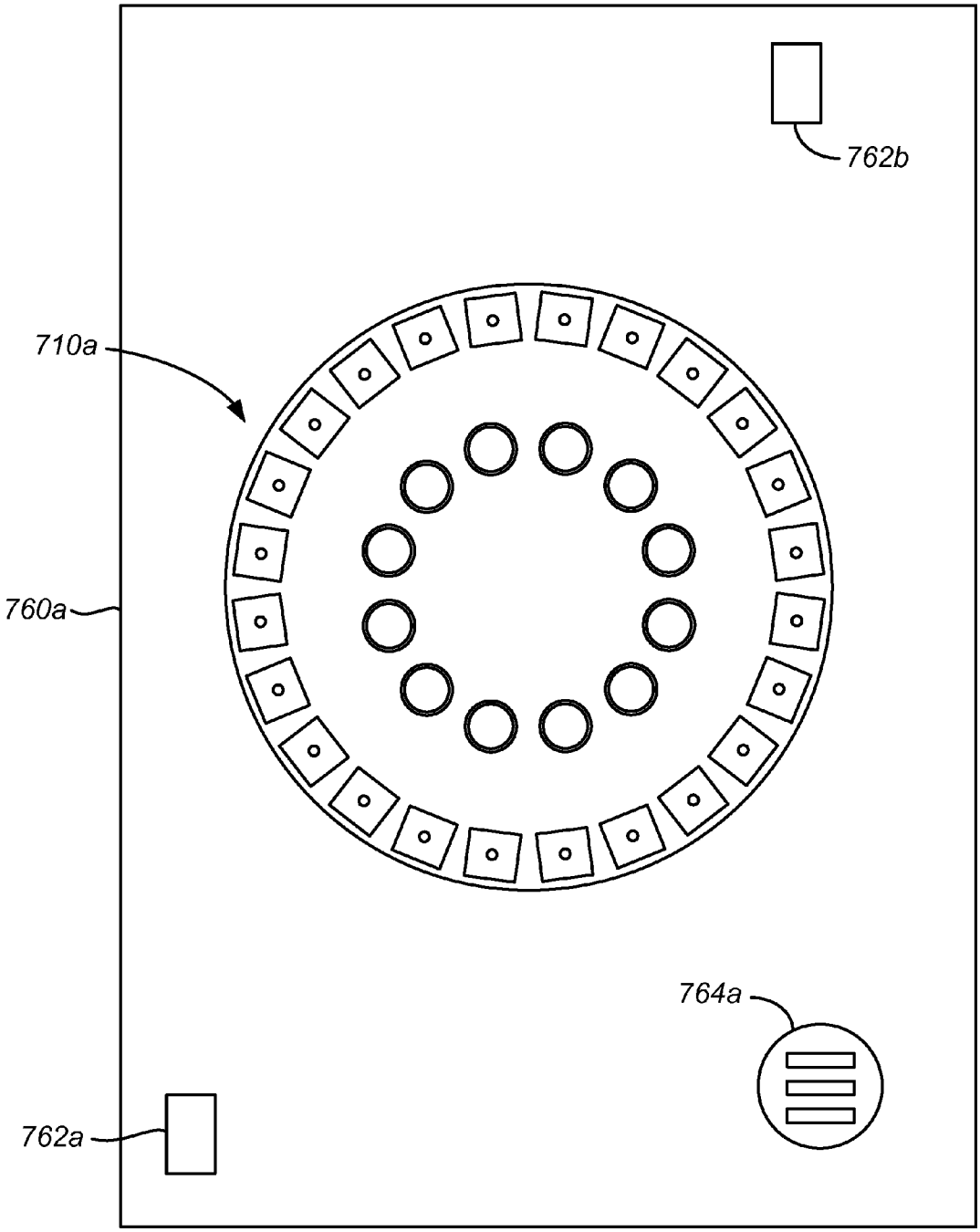
FIG. 7A is a top view of a case having a magnetic contacting array with locks.
Figure 7B:
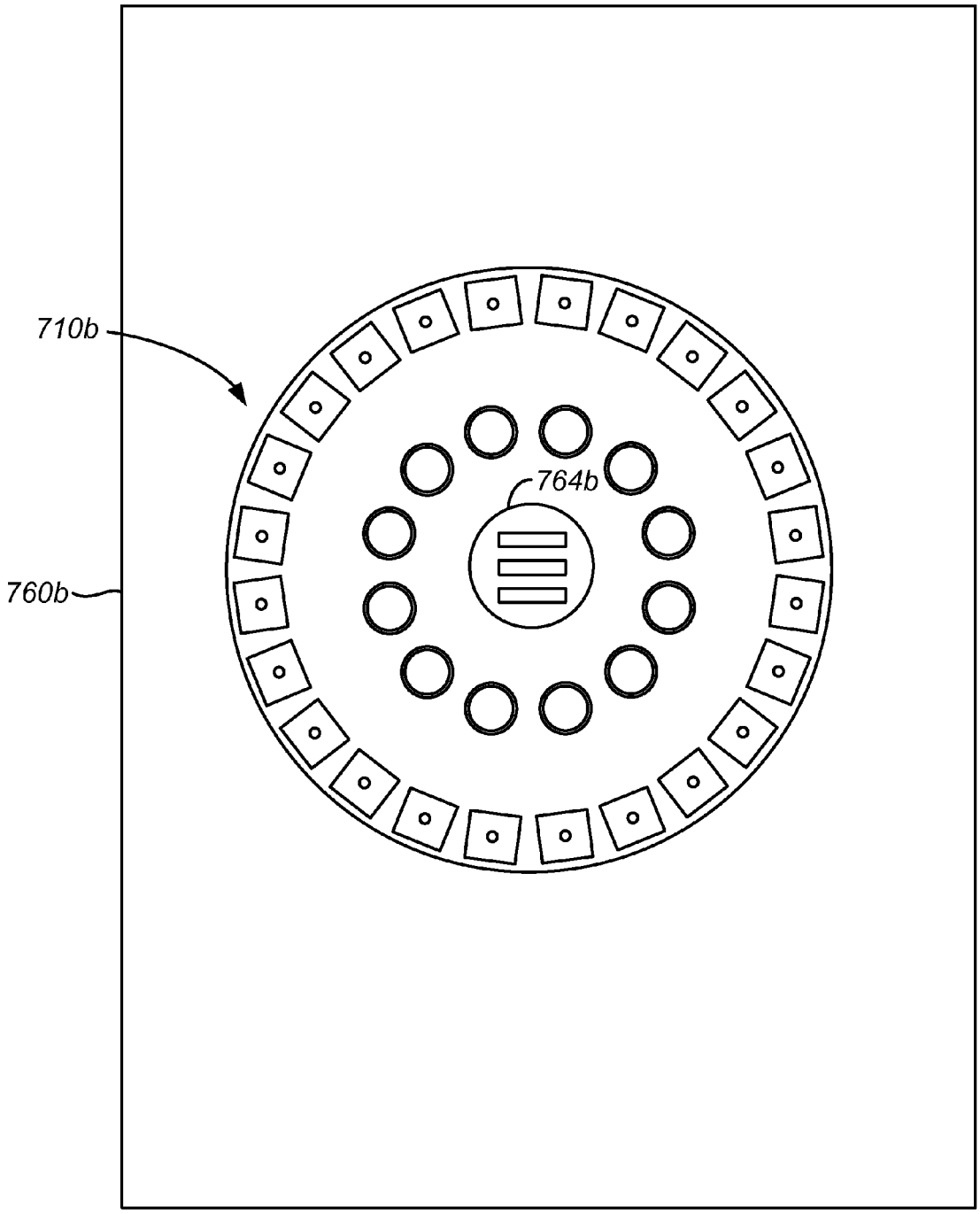
FIG. 7B is a top view of a case having a magnetic contacting array with a lock.

FIGS. 7A and 7B illustrate cases 760*a*, 760*b* integrating magnetic contacting arrays 710*a*, 710*b*, respectively. Magnetic contacting arrays 710*a*, 710*b* may be any of the magnetic contacting arrays described herein. Case 760*a* includes two manual locks 762*a*, 762*b* and one mechanical lock 764*a*, but can include any type or number of either lock. Manual locks 762*a*, 762*b* can comprise permanent or dynamic magnets, for example, which form a magnetic connection with magnets on other devices, locking the devices together and in place. A dynamic magnet is, for example, a magnet in which the magnetic field is generated by an electrical current flowing into a coil wrapped around a core. Mechanical lock 764*a* can be any type of suitable lock, such as, for example, a fixed male-female mating lock. The male-female mating lock may comprise, for example, a male portion moving into the female portion due to magnetic force; a magnetic field or pressure applied to a sideways pin to push into a second pin on the male portion; or a rotating screw extending into a female portion. Another example of a suitable mechanical lock 764*a* is a clamp on one side extending over a magnet on the other side, providing both a physical and a magnetic lock. Although shown in FIG. 7A in particular positions and locations, it is contemplated that locks 762*a*, 762*b* and 764*a* can be positioned or distributed anywhere on case 760*a* or magnetic contacting array 710*a*. For example, lock 762*b* can be positioned centrally just above magnetic contacting array 710*a*. Further, locks 762*a*, 762*b* and 764*a* can all be of the same type. In one example, one or all of locks 762*a*, 762*b* and 764*a* comprise pin-mounted magnets, similar to how magnet 814 is mounted with pin 872 in FIG. 8, described herein.

In another example, lock 764*b* of FIG. 7B is positioned at the center of magnetic contacting array 710*b*, and can be a mechanical lock, fixed magnet, dynamic magnet, and/or a manual lock. In one embodiment, lock 764*b* is an electromagnetic lock that acts as an activation magnet for magnetic contacting array 710*b*. In this embodiment, the activation magnet can comprise a physical or magnetic switch that activates the magnetic contacting array 710*b*. Although shown and described as particular shapes and sizes, it is contemplated that locks 762*a*, 762*b*, 764*a* and 764*b* can be of any shape and/or size.

Figure 8:
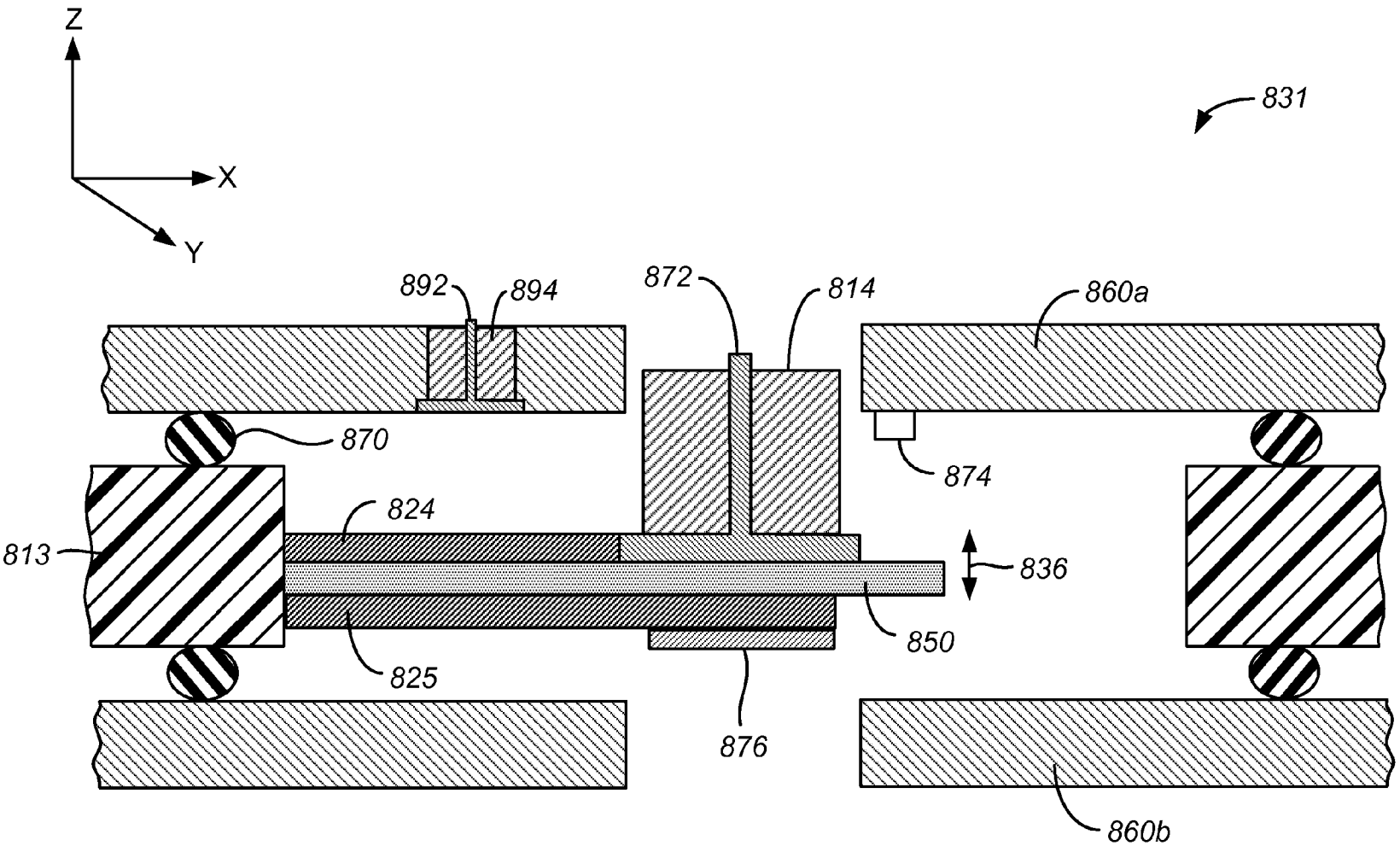
FIG. 8 is a cross-sectional view of a magnetic contacting array.

FIG. 8 is a cross-sectional view of a device 831 having a magnetic contacting array according to one embodiment. The magnetic contacting array shown in FIG. 8 can be any of the magnetic contacting arrays described herein. The magnetic contacting array is housed between a case top 860*a* and a case bottom 860*b*. Case top 860*a* and case bottom 860*b* together form a case or housing for the magnetic contacting array or a mobile device, for example. In this embodiment, case top 860*a* incorporates a lock comprising a magnet 894 mounted to a pin 892. Pin 892 can be pre-formed or post-formed, as described further herein with respect to pin 872. Magnet 894 can form a magnetic connection with magnets on other devices, locking the devices together and in place. Together, magnet 894 and pin 892 can correspond to manual locks 762*a* and/or 762*b* of FIG. 7A, for example.

From flexible printed circuit board 813 extends flexible printed circuit board arm 850. Flexible printed circuit board arm 850 can be made of the same material as flexible printed circuit board 813, and can either be separate from and bonded to flexible printed circuit board 813, or integral with flexible circuit board 813 (i.e., flexible printed circuit board 813 and flexible printed circuit board arm 850 can be formed from a single piece of flexible printed circuit board material).

A water seal 870 is provided between flexible printed circuit board 813 and case top 860*a*, as well as between flexible printed circuit board 813 and case bottom 860*b* in this embodiment. Water seal 870 can provide a barrier between any fluid entering case top 860*a* and case top 860*b* and any or all mechanical, electrical, magnetic, or any other components, including the electronic components of the magnetic contacting array, such as the memory, processor and driver shown in FIG. 4, for example. However, it is contemplated that water seal 870 can be entirely omitted in other embodiments.

Magnet 814 is shown with a hole (not labeled). Magnet 814 connects electrically with top trace 824 of flexible printed circuit board 813 via pin 872 through the hole. Pin 872 can be pre-formed, soldered and positioned as shown in FIG. 8 in one embodiment. In another embodiment, pin 872 is post-formed. For example, magnet 814 can be placed on a conductive base on flexible printed circuit board arm 850 in contact with top trace 824, then a conductive epoxy (or other suitable conductive adhesive) is squeezed through the hole of magnet 814 to form pin 872. In another example, conductive epoxy can be placed on flexible printed circuit board arm 850 in contact with top trace 824, then magnet 814 can be pressed into it, causing the conductive epoxy to be wicked up through the hole.

Although shown as slightly protruding from magnet 814, it is contemplated that pin 872 can be recessed within magnet 814, or may that pin 872 may not be formed at all. In another embodiment, pin 872 can be flush with magnet 814 such that magnet 814 can make flush contact with another device, such as is shown in FIGS. 3 and 4. In this embodiment, electrical conduction comes through pin 872 holding magnet 814, and magnet 814 merely provides mechanical attraction. In other embodiments, however, pin 872 can merely be a mechanical hold for magnet 814, the latter of which provides the electrical connection. This pin embodiment can be combined with any of the other embodiments described herein as a means to affix a magnet to a flexible arm, to electrically connected a magnet to a trace and/or to provide a lock, as examples.

In one embodiment, top trace 824 connects further with a contact pad (not shown), and from there to a trace of a second printed circuit board (not shown), such as second printed circuit board 35*a* of FIGS. 3 and 4. The second printed circuit board further connects to the pin of a driver circuit. In another embodiment, top trace 824 connects directly to the flexible printed circuit board, which connects directly to the pin of a driver circuit.

A bottom trace 825 is also provided opposite to top trace 824 on flexible printed circuit board arm 850, facing case bottom 860*b*. Bottom trace 825 is coupled to conductive surface 876, which can be an electrode, for example. However, it is contemplated that conductive surface 876 can be any of a number of alternatives, such as is described further herein with respect to FIG. 12. Bottom trace 825 can also be electrically connected to the pin of the same or a different driver circuit.

Bidirectional arrow 836 indicates that the mounting of magnet 814 comprises a floating characteristic, wherein the exact location of magnet 814 after coupling with another magnet (not shown) can vary in the z-direction (by at least 1 mm, in one embodiment). The movement of magnet 814 is limited by a stop 874 in this embodiment. The location or position of magnet 814 also can vary slightly in the x- and y-directions, due in part to the flexible characteristic of flexible printed circuit board 813 and flexible printed circuit board arm 850. To prevent jamming of magnet 814 due to unwanted angular movement, it is contemplated that a ring can be provided connecting flexible printed circuit board arm 850 to the other flexible printed circuit board arms (not shown) of the magnetic contacting array, such as is shown and described in FIG. 5B.

The potential for substantial adjustments in the z-direction supports an adaptive magnetic contacting array which can adjust to manufacturing tolerances observed in device 831, for example. Accordingly, good electrical contact can be provided between stacked devices, as shown in FIGS. 3 and 4, supporting currents of at least 2 amperes and data rates of at least 400 Mbps, in one example.

Figure 9:
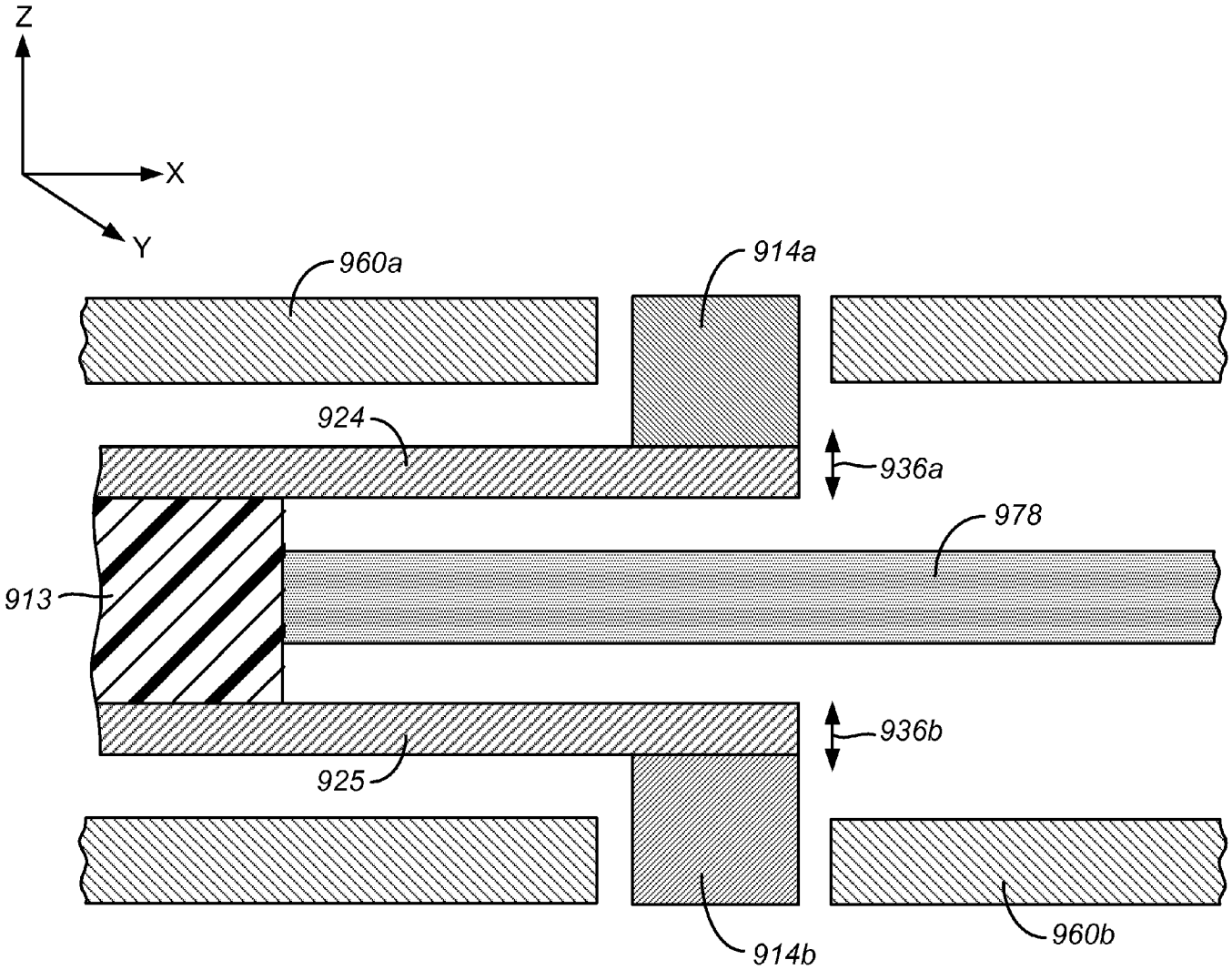
FIG. 9 is another cross-sectional view of a magnetic contacting array.

FIG. 9 is a cross-sectional view of a device 931 having a two-sided magnetic contacting array according to another embodiment. The magnetic contacting array can be any of the magnetic contacting arrays described herein. In this embodiment, printed circuit board 913 is provided between a case top 960*a* and case bottom 960*b*. Printed circuit board 913 can be flexible or rigid. A top trace 924 also serves as an arm flexibly supporting magnet 914*a*. Similarly, a bottom trace 925 also serves as an arm flexibly supporting magnet 914*b*. Flexible printed circuit board arms are not needed in this embodiment, and thus are omitted. Unlike FIG. 8, magnets 914*a*, 914*b* are provided on both sides of device 931, with a magnetic shield 978 between them to isolate their respective magnetic fields from each other. However, it is contemplated that any of a number of alternatives may replace magnet 914*a* and/or magnet 914*b*, as described further herein with respect to FIG. 12. Further, any of a number of alternatives may replace magnetic shield 978, such as, for example, a battery that provides additional battery life for a mobile device. As another example, a payment device that interacts with existing point of sale systems may replace magnetic shield 978.

Top trace 924 connects further with a contact pad (not shown), and from there to a trace of a second printed circuit board (not shown), such as second printed circuit board 35*a* of FIGS. 3 and 4. The second printed circuit board further connects to the pin of a driver circuit. Similarly, bottom trace 925 can be electrically connected to the same or a different driver circuit. In another embodiment, top trace 924 and bottom trace 925 connect to the flexible printed circuit board, which connects directly to the driver circuit.

Again, bidirectional arrows 936*a*, 936*b* indicate that the mounting of magnets 914*a*, 914*b* on top trace 924 and bottom trace 925, respectively, comprises a floating characteristic, wherein the exact location of magnets 914*a*, 914*b* after coupling with another magnet (not shown) can vary in the z-direction (by at least 1 mm, in one embodiment). The location or position of magnets 914*a*, 914*b* can also vary slightly in the x- and y-directions, due in part to the flexible characteristic of top trace 924 and bottom trace 925. To prevent jamming of magnets 914*a*, 914*b* due to unwanted angular movement, it is contemplated that a ring of insulating material can be provided connecting top trace 924 to the other top traces (not shown) of the magnetic contacting array, and/or connecting bottom trace 925 to the other bottom traces (not shown) of the magnetic contacting array, such as is shown and described with respect to FIG. 5B.

The potential for substantial adjustments in the z-direction supports an adaptive magnetic contacting array which can adjust to manufacturing tolerances observed in device 931, for example. Accordingly, good electrical contact can be provided between stacked devices, as shown in FIGS. 3 and 4, supporting currents of at least 2 amperes and data rates of at least 400 Mbps, in one example.

Figure 10:
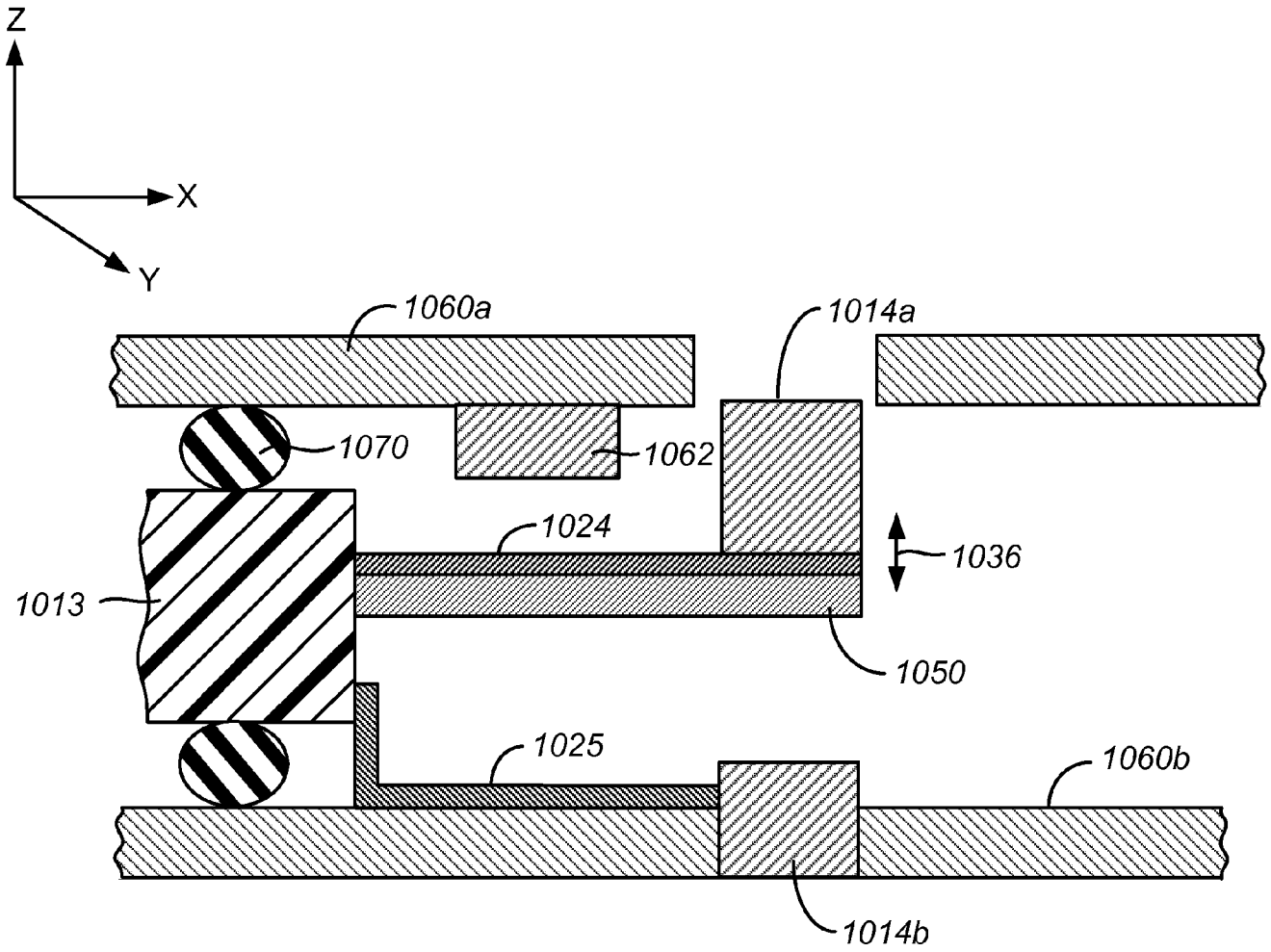
FIG. 10 is another cross-sectional view of a magnetic contacting array.

FIG. 10 is a cross-sectional view of a device 1031 having a magnetic contacting array utilizing a moving magnet 1014*a* and a static magnet 1014*b* according to another embodiment. The magnetic contacting array can be any of the magnetic contacting arrays described herein. In this embodiment, printed circuit board 1013 is provided between a case top 1060*a* and a case bottom 1060*b*. Printed circuit board 1013 can be flexible and integral with flexible arm 1050, or rigid and made from a separate material than flexible arm 1050. A top trace 1024 is provided between flexible arm 1050 and magnet 1014*a*, with magnet 1014*a* being in electrical contact with top trace 1024. Magnet 1014*a* can make electrical contact with top trace 1024 by any suitable means. For example, a cup may be presoldered to top trace 1024 of flexible arm 1050; conductive adhesive may be added to the cup; then the magnet may be placed on top of the conductive adhesive. If magnet 1014*a* is dynamic, however, magnet 1014*a* can be soldered directly to top trace 1024. In another embodiment, magnet 1014*a* can be electrically connected to top trace 1024 via a pin, such as is described with respect to FIG. 8. Top trace 1024 connects further with a contact pad (not shown), and from there to a trace of a second printed circuit board (not shown), such as second printed circuit board 35*a* of FIGS. 3 and 4. The second printed circuit board further connects to the pin of a driver circuit.

Again, bidirectional arrow 1036 indicates that the mounting of magnet 1014*a* on flexible arm 1050 comprises a floating characteristic, wherein the exact location of magnet 1014*a* after coupling with another magnet (not shown) can vary in the z-direction (by at least 1 mm, in one embodiment). The location or position of magnet 1014*a* can also vary slightly in the x- and y-directions, due in part to the flexible characteristic of flexible arm 1050. To prevent jamming of magnet 1014*a* due to unwanted angular movement, it is contemplated that a ring of material can be provided connecting flexible arm 1050 to other flexible arms (not shown) of the magnetic contacting array, such as is shown and described with respect to FIG. 5B.

The potential for substantial adjustments of magnet 1014*a* in the z-direction supports an adaptive magnetic contacting array which can adjust to manufacturing tolerances observed in device 1031, for example. Accordingly, good electrical contact can be provided between stacked devices, as shown in FIGS. 3 and 4, supporting currents of at least 2 amperes and data rates of at least 400 Mbps, in one example.

A bottom trace 1025 is also provided between printed circuit board 1013 and a static magnet 1014*b*, which does not move in the x-, y- or z-directions. Bottom trace 1025 can be electrically connected to the same or a different driver circuit than top trace 1024. Magnet 1014*b* can also support currents of at least 2 amperes and data rates of at least 400 Mbps, in one embodiment. However, it is contemplated that any of a number of alternatives may replace magnet 1014*a* and/or magnet 1014*b*, as described further herein with respect to FIG. 12.

A water seal 1070 is provided between flexible printed circuit board 1013 and case top 1060*a*, as well as between flexible printed circuit board 1013 and case bottom 1060*b* in this embodiment. Water seal 1070 can provide a barrier between any fluid entering case top 1060*a* and case top 1060*b* and any mechanical, electronic, magnetic or other components, such as, for example, the electronic components of the magnetic contacting array, such as the memory, processor and driver shown in FIG. 4. However, it is contemplated that water seal 1070 can be omitted in other embodiments.

In an optional embodiment, an additional element (not shown) may be added between flexible arm 1050 and static magnet 1014*b*, such as, for example, a magnetic shield as shown and described with respect to FIG. 9. As another example, a battery can be provided connected to printed circuit board 1013 between flexible arm 1050 and bottom trace 1025 to provide further battery life to a mobile device. However, any other alternative element described herein can be integrated into the embodiment shown in FIG. 10.

Figure 11:
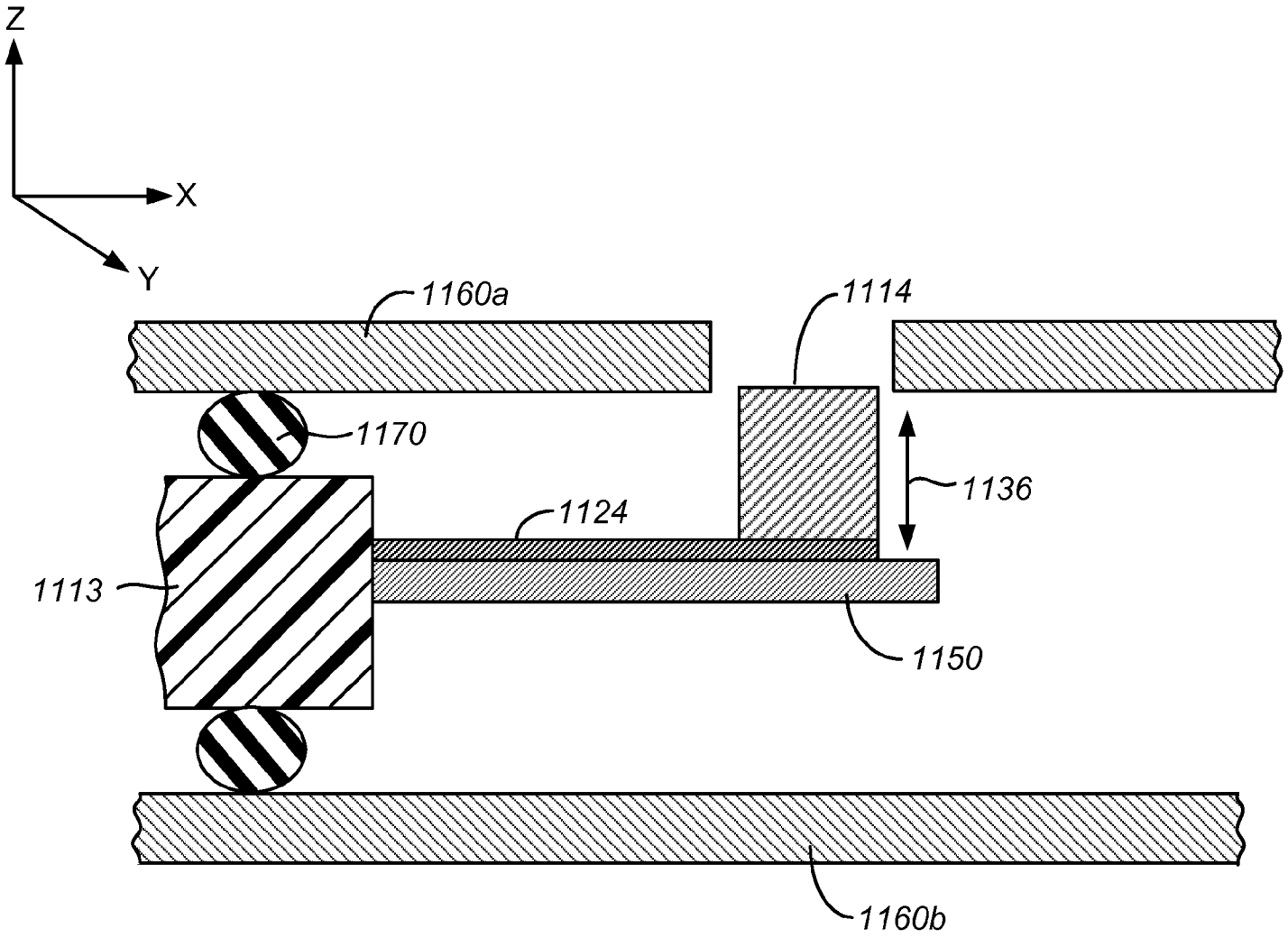
FIG. 11 is another cross-sectional view of a magnetic contacting array.

FIG. 11 is a cross-sectional view of a device 1131 having a one-sided magnetic contacting array according to an embodiment. The magnetic contacting array can be any of the magnetic contacting arrays described herein. In this embodiment, printed circuit board 1113 is provided between a case top 1160*a* and a case bottom 1160*b*. Case top 1160*a* has a hole to expose magnet 1114, while case bottom 1160*b* is closed. Printed circuit board 1113 can be flexible and integral with flexible arm 1150, or rigid and made from a separate material than flexible arm 1150. A top trace 1124 is provided between flexible arm 1150 and magnet 1114, with magnet 1114 being bonded directly to top trace 1124. In another embodiment, magnet 1114 can be electrically connected to top trace 1124 via a pin, such as is described with respect to FIG. 8. Top trace 1124 connects further with a contact pad (not shown), and from there to a trace of a second printed circuit board (not shown), such as second printed circuit board 35*a* of FIGS. 3 and 4. The second printed circuit board further connects to the pin of a driver circuit, Again, bidirectional arrow 1136 indicates that the mounting of magnet 1114 on flexible arm 1150 comprises a floating characteristic, wherein the exact location of magnet 1114 after coupling with another magnet (not shown) can vary in the z-direction (by at least 1 mm, in one embodiment). The location or position of magnet 1114 can also vary slightly in the x- and y-directions, due in part to the flexible characteristic of flexible arm 1150. To prevent jamming of magnet 1114 due to unwanted angular movement, it is contemplated that a ring of material can be provided connecting flexible arm 1150 to other flexible arms (not shown) of the magnetic contacting array, such as is shown and described with respect to FIG. 5B.

The potential for substantial adjustments of magnet 1114 in the z-direction supports an adaptive magnetic contacting array which can adjust to manufacturing tolerances observed in device 1131, for example. Accordingly, good electrical contact can be provided between stacked devices, as shown in FIGS. 3 and 4, supporting currents of at least 2 amperes and data rates of at least 400 Mbps, in one example.

A water seal 1170 is provided between flexible printed circuit board 1113 and case top 1160*a*, as well as between flexible printed circuit board 1113 and case bottom 1160*b* in this embodiment. Water seal 1170 can provide a barrier between any fluid entering case top 1160*a* and case top 1160*b* and any mechanical, electrical or magnetic components, such as the electronic components of the magnetic contacting array comprising a memory, processor and driver shown in FIG. 4. However, it is contemplated that water seal 1170 can be omitted in other embodiments.

Figure 12:
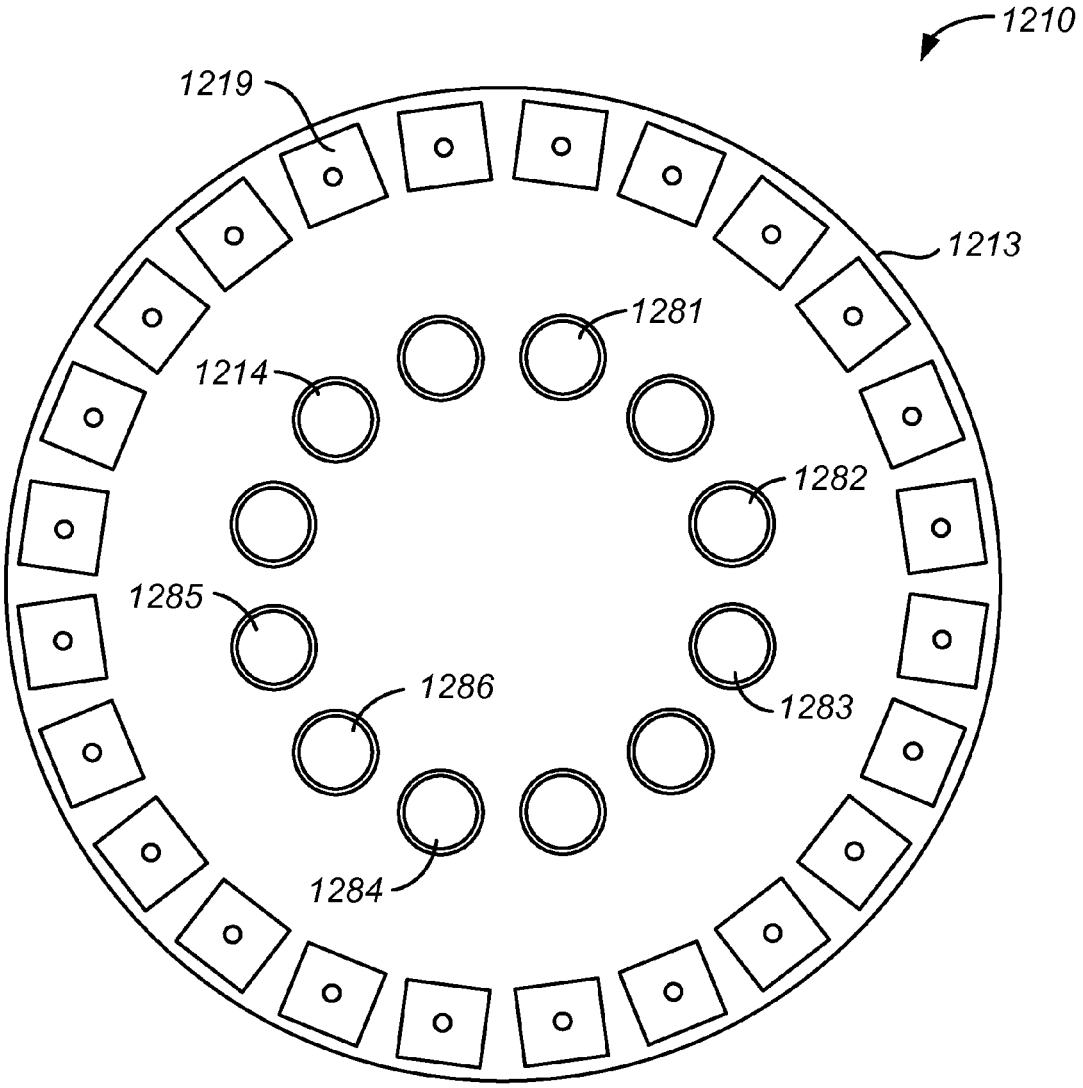
FIG. 12 is a top view of a magnetic contacting array.

FIG. 12 is a top view of a magnetic contacting array 1210. Contact pads 1219 are positioned at an outer edge of flexible printed circuit board 1213. Elements 1214, 1281, 1282, 1283, 1284, 1285 and 1286 are positioned inward of contact pads 1219 on flexible printed circuit board 1213. In this embodiment, elements 1214, 1281, 1282, 1283, 1284, 1285 and 1286 do not necessarily have to be magnets, and can be any functional or nonfunctional element. For example, element 1214 can be a dynamic magnet; element 1281 can be a passive magnet; element 1282 can be an LED; element 1283 can be a photodiode; element 1284 can be an insulator; element 1285 can be a covered magnet; and element 1286 can be an electrode. In one embodiment, any or all of elements 1214, 1281, 1282, 1283, 1842, 1285 and 1286 are releasable magnetic devices as described herein with respect to FIGS. 14-17. Other alternatives for elements 1214, 1281, 1282, 1283, 1284, 1285 and 1286 include push/pull switches, through holes for gas or liquid flow, sensors, and/or any elements that allow electromagnetic waves or signals to flow or pass out of the magnetic contacting array 1210 or the elements connected to the magnetic contacting array 1210.

It is contemplated that the embodiment described with respect to FIG. 12 can be combined with any of the other embodiments described herein. For example, it is contemplated that any of the magnets shown and described with respect to other embodiments can be replaced with any of the alternatives described with respect to FIG. 12.

Figure 13:
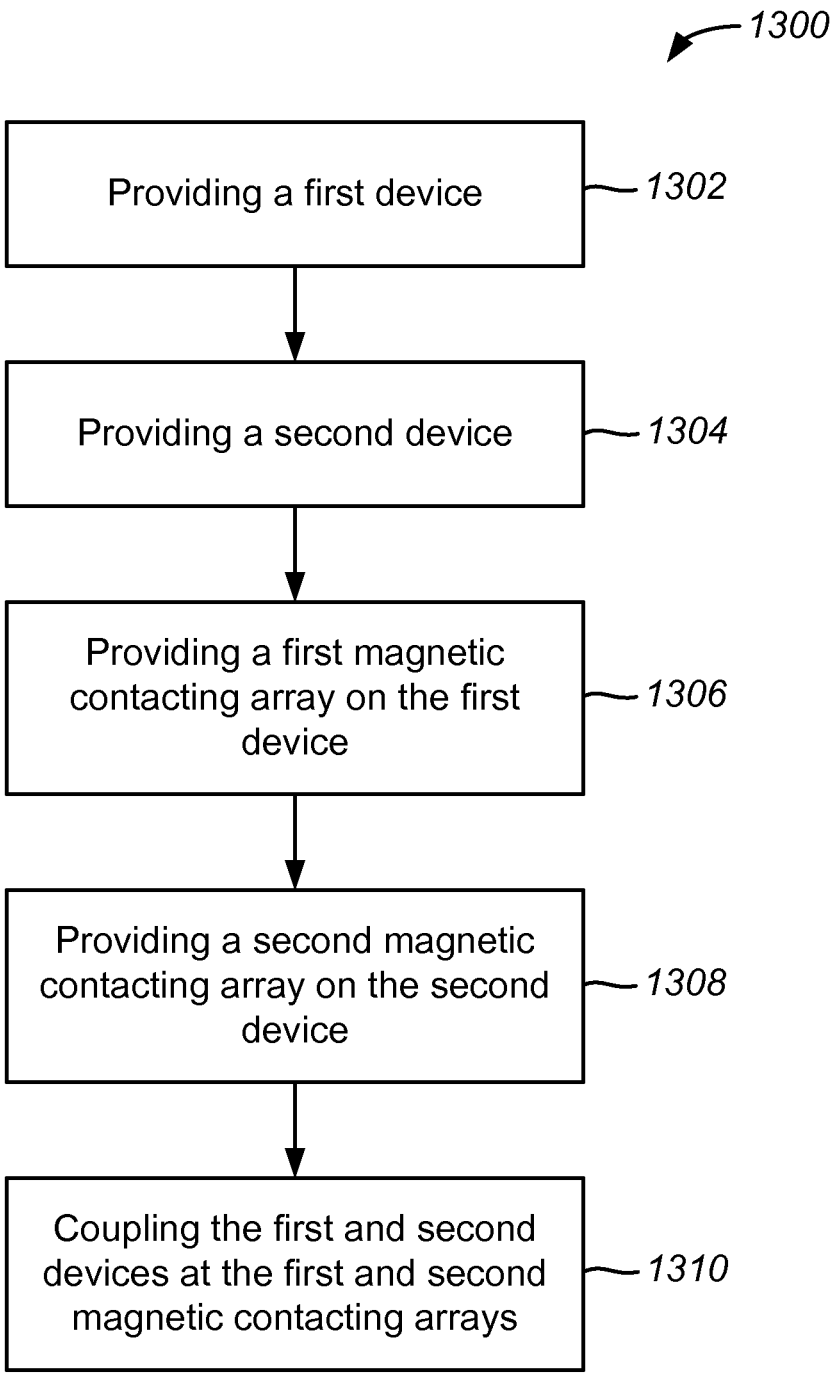
FIG. 13 is a flow chart of a method for attaching devices.

FIG. 13 depicts a flow chart 1300 describing a method for attaching devices that comprise any of the magnetic contacting arrays described herein. At step 1302, a first device is provided. At step 1304, a second device is provided. At step 1306, a first magnetic contacting array is provided on the first device. The first magnetic contacting array can be any of the magnetic contacting arrays described herein.

In one embodiment, the first magnetic contacting array comprises a flexible printed circuit board; first, second, third and fourth pluralities of contact pads; and a plurality of magnets. The first plurality of contact pads are arrayed on a first surface of the flexible printed circuit board, and the plurality of magnets are electrically attached to the first plurality of contact pads. The second plurality of contact pads match the first plurality of contact pads and are arrayed on a second surface of the printed circuit board. In one embodiment, the first plurality of contact pads are electrically isolated from the second plurality of contact pads. The third plurality of contact pads are arrayed on the first surface of the flexible printed circuit board surrounding the first plurality of contact pads. The fourth plurality of contact pads match the third plurality of contact pads and are arrayed on the second surface of the printed circuit board. In one embodiment, each contact pad of the third plurality of contact pads is pairwise electrically connected with a corresponding contact pad of the fourth plurality of contact pads.

In one embodiment, the third plurality of contact pads comprises a plurality of pairs of contact pads, each comprising a left contact pad and a right contact pad. Each left contact pad electrically connects with a contact pad of the first plurality of contact pads, and each right contact pad electrically connects with a contact pad of the second plurality of contact pads.

At step 1308, a second magnetic contacting array is provided on the second device. The second magnetic contacting array can be any of the magnetic contacting arrays described herein. In one embodiment, the second magnetic contacting array matches the positioning of the first magnetic contacting array so as to make a magnetic connection between the first and second devices. In another or the same embodiment, the second magnetic contacting array matches the structure and configuration of the first magnetic contacting array.

At step 1310, the first and second devices are coupled at the magnetic contacting arrays. For coupling, the devices have a snap-on characteristic defined by the magnets of the magnetic contacting array, and in one embodiment, by one or more magnetic, manual or mechanical locks as well, such as is described with respect to FIGS. 7A and 7B. The first and second devices can also be uncoupled at the magnetic contacting arrays. For uncoupling, a user's fingers may be used to slide the first device with respect to the second device, providing a convenient decoupling without requiring the use of either cables or tools. In other words, the magnets are very strong in the vertical direction, but are weaker and able to be separated in the orthogonal and horizontal directions.

Figure 14:
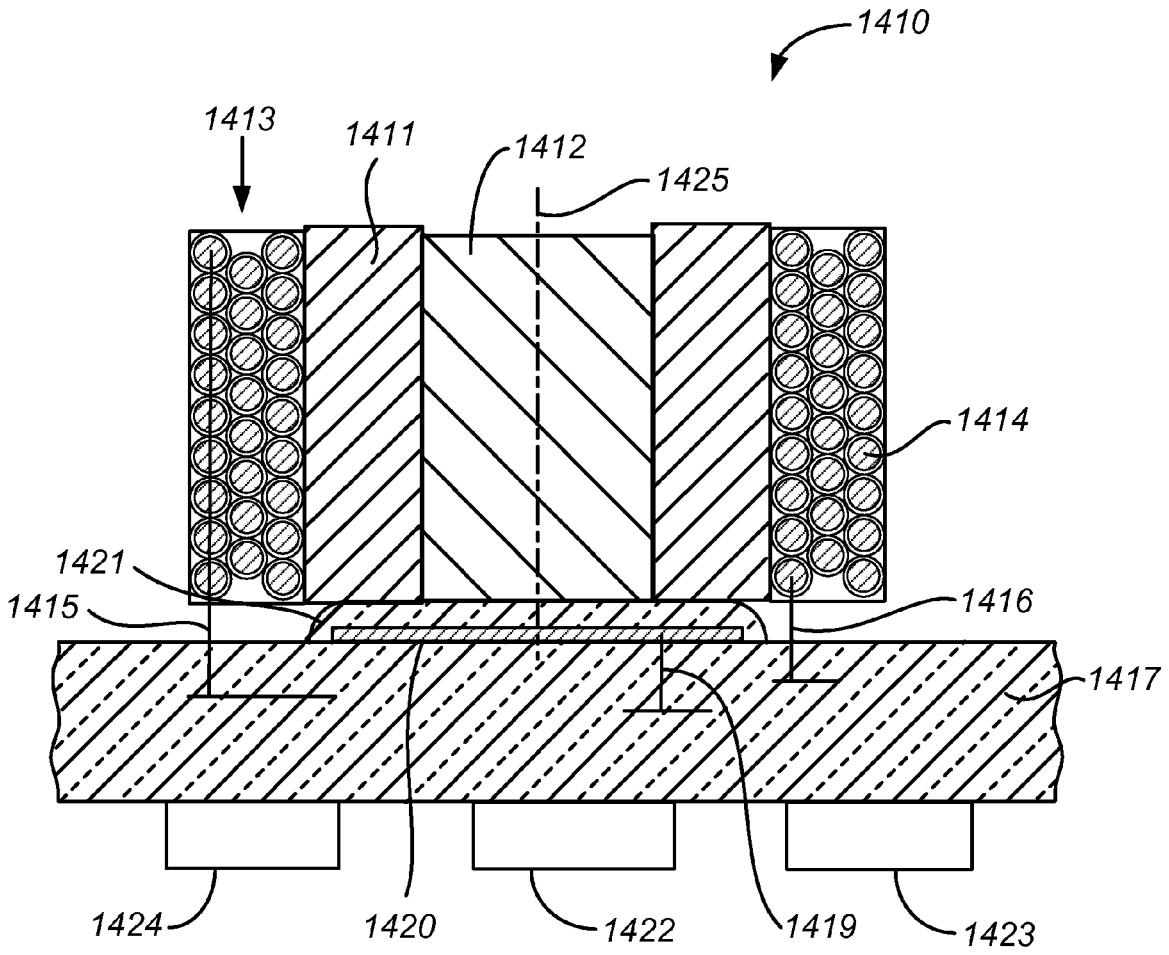
FIG. 14 is an expanded schematic view of a releasable magnetic device.

FIG. 14 illustrates a releasable magnetic device 1410 comprising a permanent magnet 1411 configured in a tubular shape. In one embodiment, permanent magnet 11 is a neodymium magnet comprising a sintered alloy of NdFeB. In another embodiment, permanent magnet 11 is an alnico or iron-nitride magnet. Magnet 11 is "permanent" in that it is permanently magnetized, as opposed to having a magnetic field generated by an electrical current flowing into a coil wrapped around a core. Permanent magnet 11 may be plated to a thickness of around 10-20 μm with nickel, gold or nickel/copper/nickel, for example, for improved corrosion resistance and hardness protection, and may have a grade of N42M or higher for operation in a consumer electronics environment at temperatures up to 100° C. Magnet 1411 may also have a permeability of around $1.05\times10^{-6}$; this property may be described as a "recoil permeability" because it is the permeability observed when a magnetized neodymium magnet is recoiled for subsequent magnetizing or demagnetizing operations. Device 1410 includes an inner core 1412 of highly permeable material such as iron or PERMALLOY, for example; core 1412 is disposed inside the tubular permanent magnet 1411 as shown. Inner core 1412 may be annealed or otherwise heat treated to increase its permeability, and a relative permeability of at least 1,000 may be achieved, as further described herein. Inner core 1412 may also be plated with nickel, gold or nickel/copper/nickel to inhibit corrosion and improve hardness.

Surrounding inner core 1412 is an excitation coil 1413 comprising wound magnet wire 1414 as shown. Although shown and described as surrounding inner core 1412, it is contemplated that excitation coil 1413 can be below, above and/or inside of permanent magnet 1411 in other embodiments and still perform the requisite functions described herein. The ends of the excitation coil 1415, 1416 are terminated in a printed circuit board 1417. Electrical continuity between permanent magnet 1411 and a corresponding termination 1419 in printed circuit board 1417 is provided via a contact pad 1420 on printed circuit board 1417 and conductive epoxy 1421. In alternative embodiments, other forms of electrical connections may be used, such as conductive clips, ultrasonic bonding, or low temperature solder. Mounted on printed circuit board 1417 are three semiconductor chips: a processor 1422, a memory 1423 and a coil driver 1424. In operation, excitation coil 1413 only has a magnetic effect when activated by a current. Memory 1423 contains instructions executable by processor 1422 to activate excitation coil 1413 by driving current through coil driver 1424. Thus, if excitation coil 1413 is not excited, device 1410 will only produce a magnetic effect corresponding to permanent magnet 1411.

Excitation coil 1413 is wound in a direction to create a magnetic field opposing the field of permanent magnet 1411, with both fields having an axial direction indicated by center line 1425. When excitation coil 1413 is excited for a brief period using a pulse of current through magnet wire 1414, the magnetic field produced by coil 1413 will exceed the magnetic field produced by permanent magnet 1411, and magnetic device 1410 will be released from an opposing magnet by magnetic repulsion. Thus, the net magnetic effect of magnetic device 1410 is temporarily reversed by excitation of coil 1413. In one embodiment, excitation coil 1413 has at least 10 turns of magnet wire 1414. Excitation coil 1413 can be automatically activated in accordance with instructions contained in the memory 1423 of the processor 1422, and/or can be activated by a user operating a switch (not shown). Although described with respect to the releasing of an opposing magnet, it is contemplated that a similar device 1410 can be used to generate a magnetic field to engage and couple magnets, or to provide for moving pins that engage magnets.

Because the relative permeability of inner core 1412 is configured to be at least 1,000 times greater than the relative permeability of permanent magnet 1411, a strong magnetic field can be produced for releasing magnetic device 1410 while having negligible effect on permanent magnet 1411. More specifically, when the same excitation field measured in amp-turns is applied simultaneously to permanent magnet 1411 and inner core 1412, the change in magnetic field in the core is 1,000 times stronger than the change in magnetic field in the permanent magnet. Neodymium magnets such as grade N42M magnets have a strong intrinsic coercive force, typically greater than 1,100 kA/m, and this protects these magnets from demagnetization due to applied magnetic fields, vibration, and elevated temperatures, among other factors.

In a miniaturized form, releasable magnetic device 1410 can have an outside diameter of 3 mm or less and a height of 2 mm or less. When operating as a contactor, releasable magnetic device 1410 can have a current carrying capacity of at least 5 amperes and a data carrying capacity of at least 400 million bits per second.

Figure 15:
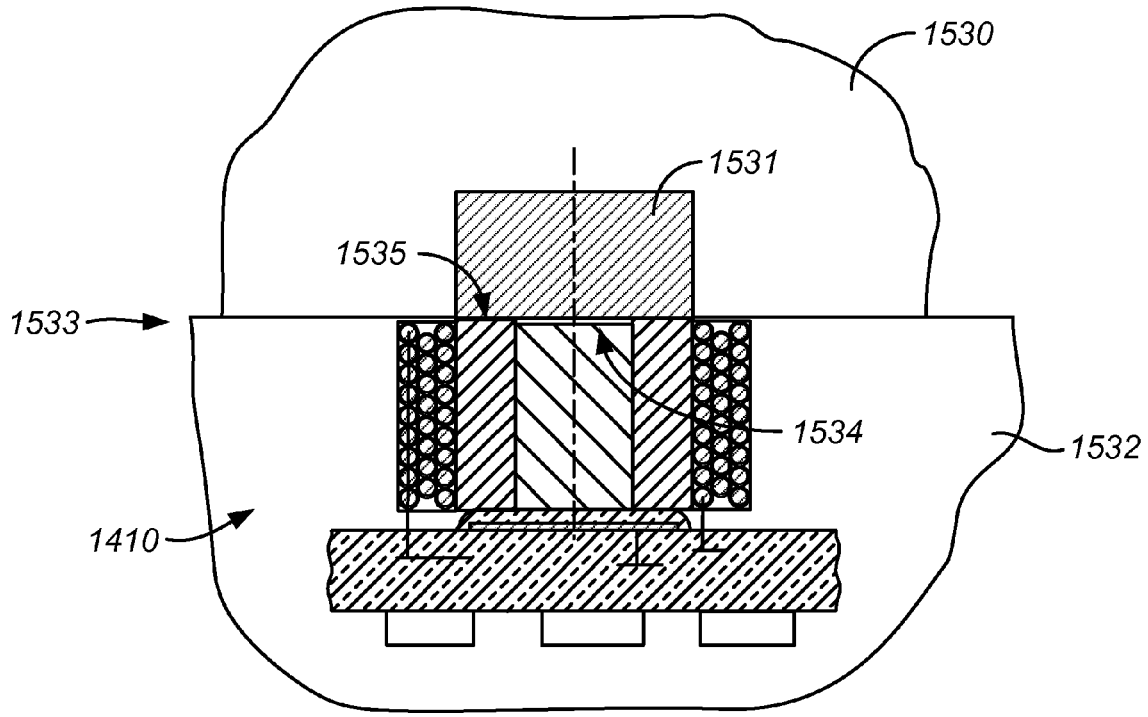
FIG. 15 is a schematic view of a contact interface comprising a first coupling magnet, a second coupling magnet that is releasable, and a planar interface between them.

FIG. 15 depicts a device 1530 incorporating a magnet 1531 coupled with an opposing device 1532 incorporating a releasable magnetic device 1410 of a disclosed embodiment. The contact interface 1533 comprises a plane, and can be described as a planar coupling interface. Surface 1534 of magnet 1531 and surface 1535 of device 1410 as shown lying in the plane of contact interface 1533. This arrangement makes it possible to magnetically couple devices in a compact arrangement, while providing releasability of the coupling. The arrangement may be useful for coupling mobile devices, wherein compactness is desirable, and the capability of automated decoupling may be particularly useful.

Device 1530 can incorporate a releasable magnetic device, such as releasable magnetic device 1410, instead of or in addition to magnet 1531. In other words, the coupling interface may comprise releasable magnets at both sides of the interface. In another embodiment, releasable magnetic device 1410 can be opposed by a magnetic material, such as an iron disc, rather than a magnet 1531. Devices 1530 and/or 1532 can also comprise one or more manual or mechanical locks to further couple the devices together, as shown and described further herein with respect to FIGS. 7A and 7B.

In one embodiment, device 1530 is a drone device that has landed on and has become magnetically coupled to device 1532, which may be a charging and/or communication station. Device 1530 is coupled to device 1532 by the magnetic attraction between magnet 1531 and the permanent magnet 1411 of device 1532. To release device 1530 from device 1532, a signal is either automatically sent from the memory 1423 to the processor 1422 of device 1532, or a switch is activated causing a signal to be sent to the processor 1422 of device 1532. The signal indicates that the processor should drive current through the coil driver 1424 of device 1532, thereby activating the excitation coil 1413 of device 1532. The net magnetic effect of releasable magnetic device 1410 is temporarily reversed by excitation of coil 1413, for as long as current is being driven through excitation coil 1413, thereby releasing device 1530 from device 1532 by magnetic repulsion.

Figure 16:
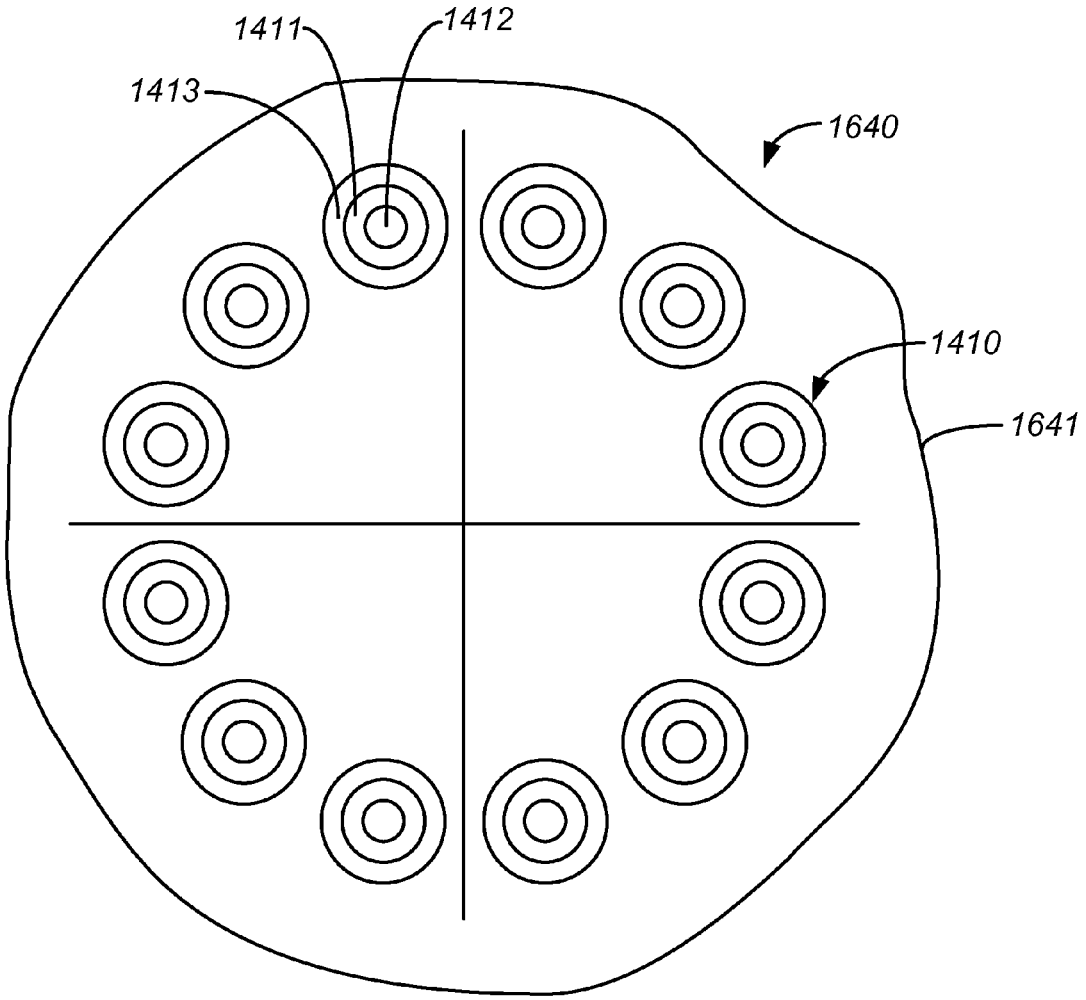
FIG. 16 is a top view of a contact array comprising a plurality of releasable magnets.

The teachings of a releasable magnetic device such as device 1410 of FIGS. 14 and 15 can be applied to a contact array comprising multiple copies of releasable magnetic device 1410, as shown in FIG. 16. A device 1640 is shown, comprising a planar attachment area 1641 and a plurality of releasable magnetic devices such as 1410. At a contact interface such as described in reference to FIG. 15, device 1640 can be opposed with a second device (not shown) having a corresponding array of magnets or magnetic devices, with pairwise coupling between each magnetic device 1410 and its corresponding magnet or magnetic device. Surface 1411 of a tubular permanent magnet may lie in the plane of planar attachment area 1641, while surface 1412 of an inner core and surface 1413 of an excitation coil may be slightly recessed from planar attachment area 1641. In another embodiment, however, all of surfaces 1411-1413 may lie in the plane of planar attachment area 1641.

Figure 17:
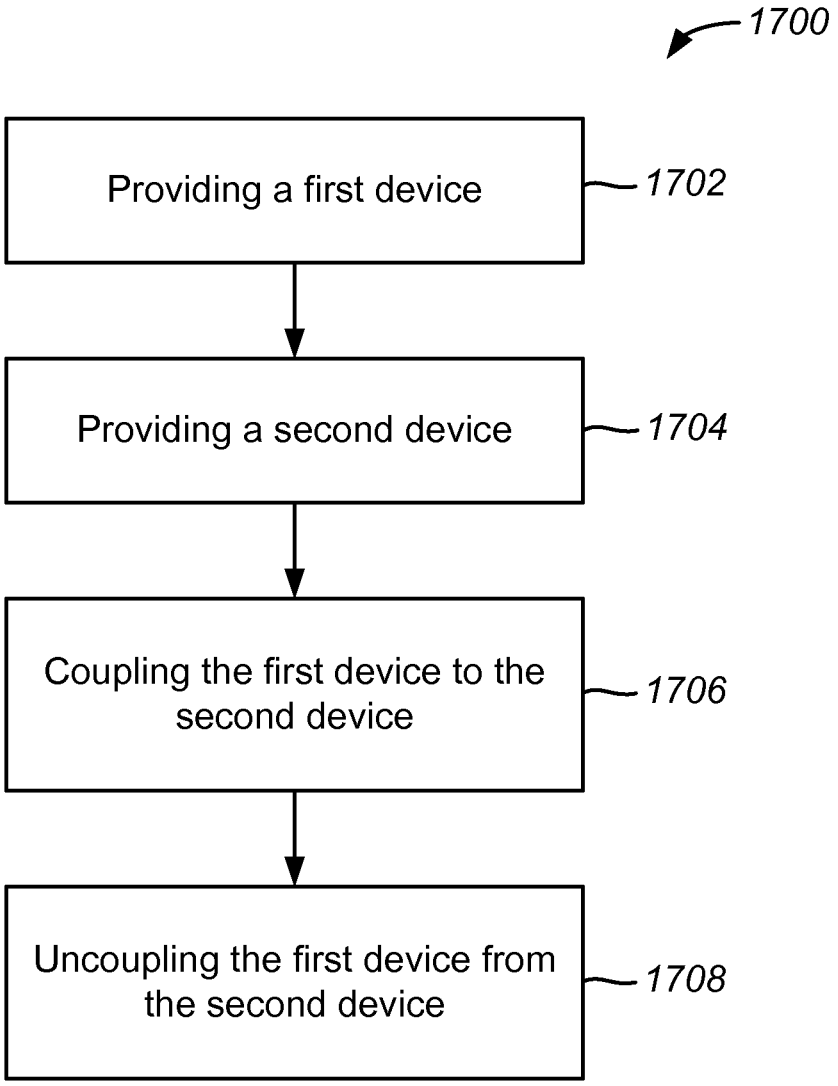
FIG. 17 is a flow chart of a method for coupling and uncoupling devices.

FIG. 17 is a flow chart 1700 of a method for coupling and uncoupling devices. At step 1702, a first device comprising a first magnet is provided. The first device may be, for example, device 1530 of FIG. 15. At step 1703, a second device is provided. The second device comprises a core of high permeability material, a second magnet surrounding the core of high permeability material, and an excitation coil. The second device may be, for example, device 1532 of FIG. 15.

At step 1706, the first device and the second device are coupled by magnetic attraction between the first magnet of the first device and the second magnet of the second device. At step 1708, the first device is uncoupled from the second device due to the activation of the excitation coil, which reduces the magnetic attraction between the first magnet and the excitation coil. In some embodiments, decreasing or reducing the attraction comprises creating magnetic repulsion between the first magnet of the first device and the excitation coil of the second device. In other words, the net magnetic effect of the second device is temporarily reversed by activation of the excitation coil, for as long as current is being driven through the excitation coil, thereby separating the first device from the second device by magnetic repulsion.

It is contemplated that any of the embodiments of the magnetic contacting array described herein can be implemented in conjunction with any of the embodiments of the releasable magnetic device described herein. In addition, any of the magnets shown and described with respect to the magnetic contacting arrays can be releasable magnetic devices. For example, with respect to FIG. 12, elements 1281, 1283, 1284 and 1285 can be releasable magnetic devices, while the remaining elements (e.g., elements 1214, 1282, 1286) are permanent magnets. However, when coupled to another device, the magnetic repulsion generated by releasable magnetic device elements 1281, 1283, 1284 and 1285 when their respective excitation coils are activated can be sufficient to uncouple the entire contacting array 1210 (including both the releasable magnetic devices 1281, 1283, 1284 and 1285 and the permanent magnets) from the other device. In another or the same embodiment, a single or multiple releasable magnets can be used as a lock outside of or as a part of the magnetic contacting array. In addition, all aspects of the adaptable contacting array structure described herein can be combined in any fashion with the releasable magnetic device described herein.

Further, although shown and described in particular positions and of particular sizes and shapes, it is contemplated that the various elements described herein can be in any position, can be any size, and can be any shape, while still maintaining the necessary configurations and connections for functioning as described herein. For example, with respect to FIG. 1, some or all of contact pads 19, 20 can be circular instead of square; some or all of magnets 14 can be rectangular instead of circular; and magnetic contacting array 10 can be triangular instead of circular. Further, with respect to FIGS. 14-16, inner core 1412, permanent magnet 1411, and excitation coil 1413 do not have to be tubular and can be independently selected shapes, similar or different from each other. These are merely examples of alternatives that may be implemented; however, many other alternatives are available as appreciated by one skilled in the art.

While illustrative embodiments of the application have been described in detail herein, it is to be understood that the inventive concepts may be otherwise variously embodied and employed, and that the appended claims are intended to be construed to include such variations, except as limited by the prior art.

What is claimed is:

1. A magnetic contacting array comprising:

a printed circuit board including a plurality of contact points;

a plurality of flexible arms extending from the printed circuit board, each of the plurality of flexible arms including a contact pad, thereby defining a plurality of contact pads wherein each of the plurality of flexible arms includes a proximal end connected to the printed circuit board and a distal end;

a ring fixed to and coupling together each distal end of each of the plurality of flexible arms; and a plurality of elements including a plurality of magnets, wherein a magnet of the plurality of magnets includes a contact face that contacts and is attached to a corresponding one of the plurality of contact pads, the corresponding contact pad being disposed between the magnet and one of the plurality of flexible arms, and wherein at least one contact point of the plurality of contact points is electrically connected to the contact pad that is attached to the contact face of the magnet.

2. The magnetic contacting array of claim 1, wherein the plurality of contact points comprises second contact pads.

3. The magnetic contacting array of claim 1, wherein the plurality of flexible arms extend from a first end to a second end, wherein each of the plurality of flexible arms includes the contact pad at the second end, and wherein the plurality of flexible arms are fixedly connected to each other at the first end and the second end.

4. The magnetic contacting array of claim 1, wherein the plurality of elements further includes at least one of a static magnet, a passive magnet, a dynamic magnet, a covered magnet, a light-emitting diode (LED), a photodiode, an insulator and a covered magnet.

5. The magnetic contacting array of claim 1, wherein at least one of the plurality of flexible arms includes two or more contact points.

6. The magnetic contacting array of claim 1, wherein each of the plurality of magnets is configured to convey current.

7. The magnetic contacting array of claim 1, wherein each of the plurality of magnets is configured to transmit data.

8. The magnetic contacting array of claim 1, wherein the ring and the printed circuit board comprise a same material.

* * * * *